US006421972B1

(12) United States Patent
Dalphond et al.

(10) Patent No.: US 6,421,972 B1
(45) Date of Patent: Jul. 23, 2002

(54) MODULAR WALL COMPONENT WITH INSULATIVE THERMAL BREAK

(75) Inventors: Raymond F. Dalphond, Stoneham, MA (US); Richard R. Dalphond, Londonderry, NH (US)

(73) Assignee: I Mozaic Trust, Chelmsford, MA (US)

( * ) Notice: Subject to any disclaimer, the term of this patent is extended or adjusted under 35 U.S.C. 154(b) by 0 days.

(21) Appl. No.: 09/559,184

(22) Filed: Apr. 27, 2000

(51) Int. Cl.[7] ..... E04B 2/58

(52) U.S. Cl. ..... 52/309.7; 52/284; 52/309.16; 52/407.3; 52/584.1; 52/779; 52/794.1; 52/800.12

(58) Field of Search ..... 52/794.1, 309.7, 52/309.13, 309.14, 309.16, 407.3, 407.4, 404.2, 779, 800.11, 800.12, 582.2, 584.1, 284

(56) References Cited

U.S. PATENT DOCUMENTS

| | | | | | |
|---|---|---|---|---|---|
| 1,604,079 | A | * | 10/1926 | Schwartz | 52/584.1 X |
| 2,717,664 | A | * | 9/1955 | Grafman | 52/584.1 X |
| 2,844,848 | A | | 7/1958 | Couse et al. | |
| 3,134,464 | A | | 5/1964 | Markle | |
| 3,217,455 | A | | 11/1965 | Burges | |
| 3,305,986 | A | * | 2/1967 | Mathews | 52/270 |
| 3,343,314 | A | | 9/1967 | Smith | |
| 3,427,775 | A | | 2/1969 | Bachrich | |
| 3,775,920 | A | * | 12/1973 | Schneller | 52/241 |
| 4,114,333 | A | | 9/1978 | Jones et al. | |
| 4,223,500 | A | | 9/1980 | Clark et al. | |
| 4,633,634 | A | | 1/1987 | Nemmer et al. | |
| 4,641,468 | A | * | 2/1987 | Slater | 52/309.7 X |
| 4,674,253 | A | * | 6/1987 | Young | 52/404.2 |
| 4,742,665 | A | | 5/1988 | Baierl | |
| 5,265,389 | A | | 11/1993 | Mazzone et al. | |
| 5,269,109 | A | * | 12/1993 | Gulur | 52/309.7 X |
| 5,417,023 | A | | 5/1995 | Mandish | |
| 5,524,400 | A | * | 6/1996 | Schmechel | 52/309.7 X |
| 5,765,330 | A | | 6/1998 | Richard | |
| 5,799,462 | A | * | 9/1998 | McKinney | 52/309.7 X |
| 5,953,883 | A | * | 9/1999 | Ojala | 52/407.3 X |
| 6,158,190 | A | * | 12/2000 | Seng | 52/309.14 X |

FOREIGN PATENT DOCUMENTS

| | | | | |
|---|---|---|---|---|
| DE | 2453196 | * | 5/1976 | 52/584.1 |
| FR | 2621632 | * | 4/1989 | 52/794.1 |
| FR | 2639986 | * | 6/1990 | 52/794.1 |

OTHER PUBLICATIONS

Brian Rogers, "Amisk International Exports Steel/EPS Panel System," Automated Builder, p. 34–35, (Apr. 25, 1999).

* cited by examiner

*Primary Examiner*—Laura A. Callo
(74) *Attorney, Agent, or Firm*—O'Connell Law Firm

(57) ABSTRACT

A modular wall component with an insulative thermal break for preventing the creation of a continuous thermal path across the modular wall component. The modular wall component may be formed with an insulated frame structure that is fixed to an open frame structure with an insulative thermal break interposed therebetween. The insulated frame structure may be formed with a plurality of vertical track members coupled to an upper track member and a lower track member. At least one sheet of insulative material is interposed into the insulated frame structure. The open frame structure may have a plurality of vertical framing studs coupled to an upper framing track and a lower framing track.

35 Claims, 14 Drawing Sheets

MODULAR WALL COMPONENT WITH INSULATIVE THERMAL BREAK

FIELD OF THE INVENTION

The present invention relates generally to building structures. Stated more particularly, this patent discloses and protects a modular wall component with an insulative thermal break that is formed by joined metal frame structures with integral insulative material.

BACKGROUND OF THE INVENTION

In relatively recent times, it has become increasingly commonplace for building structures, particularly the exterior walls thereof, to be assembled by the coupling of a plurality of prefabricated or modular wall components. Typically, such prefabricated wall components are crafted in predetermined dimensions at a factory and then transported to the site of the building structure for assembly. In their early days and, to a lesser extent, continuing until the present, these prefabricated wall components were an assembly of wood studs. Wood structures were found to be advantageous for a number of reasons including that they demonstrate better insulative properties than corresponding metal structures.

However, wood stud wall components suffer from a number of disadvantages. For example, wood is relatively heavy, tends to expand and contract, and is subject to inherent imperfections. Accordingly, it is becoming more commonplace to form modular wall components of metal studs to exploit their lightness and consistent quality and structural performance. Unfortunately, metal stud structures of the prior art have exhibited the major disadvantage of being excellent conductors of heat. With this, building structures formed of such metal stud modular wall components can exhibit undesirable heat loss in the winter as heat is transmitted from within the building structure along a continuous metallic thermal path provided by the metal studs. Furthermore, the metal studs can lead to disadvantageous heat gains as summer heat can be transmitted into the building structure along the continuous thermal path.

Advantageously, a number of inventors have sought to provide a modular wall component that exhibits the desirable characteristics of metal stud structures with respect to weight, strength, and consistent performance while minimizing or avoiding the undesirable heat transfer properties resulting from a continuous thermal path provided by metal-to-metal connections. For example, one method for minimizing heat gains and losses has been to provide insulation between the metal studs of the panel framework. Most commonly, this has been accomplished by the industry standard practice of inserting insulative material into the frame assembly cavities once the framework is completely erected at the job site. In later days, foam insulation has been injected into the spacing between the metal studs.

Unfortunately, both of these practices require the separate steps of erecting the modular components into a complete wall structure and then insulating that completed structure. With this, the time required for creating a complete wall installation is increased as is the overall cost of the building structure. Furthermore, even the most diligent installer of insulation will be unable to fill each and every void and gap between the studding framework, and the situation will certainly be worsened when the quality of the installation depends on the work product of a less than diligent installer. Still further, these methods of insulation disadvantageously leave continuous paths of heat transfer across the modular wall component intact.

Realizing this, a number of further inventors have developed modular wall components that are provided with a layer of insulation during the initial assembly of the wall component. A few of these inventors have been so industrious as to further attempt to create a break in the thermal path between the outer surface and the inner surface of the component. Unfortunately, these prior art devices have continued to suffer from a number of problems. By way of example, some such devices have confronted particular deficiencies of the prior art while either ignoring or even exacerbating other deficiencies. Further inventions have addressed a plurality of deficiencies of the prior art only by the creation of undesirably complex and expensive constructions.

For example, a prefabricated wall panel with an integral layer of insulation is disclosed in U.S. Pat. No. 4,633,634 to Nemmer et al. where a plurality of expanded polystyrene panels are joined in an edge-to-edge relationship and are connected by C-shaped metal channels that are fastened together in a back-to-back relationship. Advantageously, the outer surfaces of the polystyrene panels extend beyond the outer edges of the metal channels whereby the invention avoids providing a continuous heat path. In doing so, however, the outer surface of the panel of the '634 patent disadvantageously does not provide a secure surface to which outer wall coverings can be fastened. Furthermore, the panel has just a single frame structure whereby its strength and rigidity are compromised.

U.S. Pat. No. 3,217,455 to Burges reveals another modular panel that seeks to provide improved thermal properties. In this device, continuous metal paths are eliminated by an arrangement of members of insulating material, such as neoprene, that are fused together by vulcanization or other similar process. With this, the structure is said to provide improved properties of acoustic and thermal insulation. Disadvantageously, the Burges invention, in a manner typical of such prior art structures, achieves these improved properties at the expense of providing a structure that is an exceedingly complex arrangement of a plurality of elements that must be joined by complex processes.

In light of the state of the art as summarized above, it will be apparent that there is a need for a modular wall component structure that satisfies one or more of the deficiencies that the prior art has been unable to meet effectively. It is clearer still that a modular wall component structure that meets each and every need left by the prior art while providing a number of heretofore unrealized advantages thereover would represent a marked advance in the art.

SUMMARY OF THE INVENTION

Advantageously, the present invention sets forth with the broadly stated object of providing a modular wall component that solves each of the problems left by the prior art while providing a number of heretofore unrealized advantages thereover.

Stated more particularly, a principal object of the present invention is to provide a modular wall component that provides improved properties of thermal and acoustic insulation by eliminating continuous metal paths extending from an inner surface to an outer surface of the wall component.

A further object of the invention is to provide a modular wall component that eliminates continuous metal paths while remaining exceedingly simple and efficient in construction.

Yet another object of the invention is to provide a modular wall component that demonstrates exemplary structural strength and rigidity.

Still another object of the invention is to provide a modular wall component that is light in weight such that it can be lifted and managed easily and safely.

A still further object of the invention is the provision of a modular wall component that accomplishes the aforementioned objects while providing secure attachment surfaces on both sides of the wall component.

These and further objects and advantages of the present invention will become obvious both to one who reviews the present specification and drawings and to one who has an opportunity to make use of an embodiment of the present invention.

In accomplishing the aforementioned objects, a most basic embodiment of the present invention for a modular wall component essentially comprises an insulated frame structure that is fixed to an open frame structure. The insulated frame structure incorporates a plurality of interconnected structural frame members and a means for insulating the insulated frame structure. The open frame structure is formed with a plurality of interconnected structural frame members, and an insulative thermal break is interposed between the insulated frame structure and the open frame structure. With this, the creation of a continuous thermal path across the modular wall component is prevented.

The insulated frame structure may be constructed with a plurality of vertical track members that each have a web portion and first and second legs. The vertical track members are coupled to upper and lower track members that each have a web portion and first and second legs. This preferably may be accomplished with the plurality of vertical track members coupled to the upper and lower track members with the web portion of each vertical track member fixed to the first legs of the upper and lower track members.

The means for insulating the insulated frame structure may be in the form of at least one sheet of insulative material that can be interposed into the insulated frame structure with at least one of the first and second legs of each of the vertical track members embedded in the at least one sheet of insulative material.

The plurality of interconnected structural frame members of the open frame structure may comprise a plurality of vertical framing studs that are coupled to an upper framing track and a lower framing track. In a preferred embodiment, the vertical framing studs each have a web portion, first and second flanges disposed generally perpendicularly to the web portion, and returns disposed generally perpendicularly to the flanges. The upper framing track and the lower framing track each have a web portion and first and second legs. With this, the upper and lower framing tracks would have a U-shaped cross-section while the vertical framing studs would have a C-shaped cross-section. The insulated frame structure and the open frame structure preferably are coupled with the second legs of the upper and lower track members of the insulated frame structure adjacent to the upper and lower framing tracks of the open frame structure.

Ideally, the first and second legs of each of the plurality of vertical track members have a given height that is less than a thickness of the at least one insulative sheet. With this, the first and second legs of the vertical track member extend only partially through the at least one insulative sheet, and contact between the vertical track members and the open frame structure is avoided. This advantageously contributes to the prevention of the creation of a continuous thermal path between the insulated frame structure and the open frame structure.

The insulative thermal break interposed between the insulated frame structure and the open frame structure may comprise a layer of insulative adhesive material interposed between the second leg of the upper track member of the insulated frame structure and the first leg of the upper framing track of the open frame structure. Also, a layer of insulative adhesive material may be interposed between the second leg of the lower track member of the insulated frame structure and the first leg of the lower framing track of the open frame structure. With this, the creation of a continuous thermal path between the insulated frame structure and the open frame structure is further prevented.

The means for fixing the insulated frame structure to the open frame structure may be in the form of a plurality of threaded fasteners in combination with a plurality of threadedly engaged fastening nuts. Alternatively or additionally, the means for fixing the insulated frame structure to the open frame structure could comprise a layer of adhesive. Where fasteners are used, an insulating sleeve of thermally insulative material will preferably surround at least a portion of each of the threaded fasteners. An insulating disk of thermally insulative material may be interposed proximal to each fastening nut. With this, the formation of a continuous thermal path between the insulated frame structure and the open frame structure along the plurality of threaded fasteners will be prevented still further.

The open frame structure may be assembled with the first and second flanges of the vertical framing studs coupled to the first and second legs of the upper and lower framing tracks. Under such an arrangement, the plurality of threaded fasteners may be passed through the webs of the vertical track members of the insulated frame structure, through the at least one insulative sheet, and through a flange of the vertical framing studs of the open frame structure.

Also, the upper and lower track members of the insulated frame section may be mechanically coupled to the upper and lower frame tracks of the open frame structure by a plurality of thermally insulative anchoring nuts in combination with a plurality of threaded fasteners. The insulative anchoring nut may take the form of a generally flat base member along with a plurality of resiliently biased legs that project from the base member. With this, the resiliently biased legs of the insulative anchoring nut can be inserted into a bore hole in the second leg of the upper track member of the insulated frame structure, and the threaded fastener can be threaded into the insulative anchoring nut to cause the resiliently biased legs to spread apart. This will lock the threaded fastener and the insulative anchoring nut in place thereby fixing the upper framing track of the open frame structure and the upper track member of the insulated frame structure in place relative to one another.

With a plurality of embodiments of the present invention for a modular wall component described, one will appreciate that the foregoing discussion broadly outlines the more important features of the invention merely to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

REFERENCE NUMERALS

In the accompanying figures and in the ensuing description, reference numbers are employed as follows:

| | |
|---|---|
| modular wall component with an insulative thermal break | 10 |
| outer, insulated frame structure | 12 |
| inner, open frame structure | 14 |
| vertical track members | 16 |
| upper track member | 18 |
| lower track member | 20 |
| web of vertical track members | 22 |
| first leg of upper track member | 24 |
| second leg of upper track member | 25 |
| first leg of lower track member | 26 |
| second leg of lower track member | 27 |
| first insulative sheet | 28 |
| second insulative sheet | 30 |
| web of upper track member | 32 |
| web of lower track member | 33 |
| first leg of vertical track members | 34 |
| second leg of vertical track members | 36 |
| vertical framing studs | 38 |
| upper framing track | 40 |
| lower framing track | 42 |
| web of vertical framing studs | 44 |

-continued

| | |
|---|---|
| first flanges of vertical framing studs | 46 |
| second flanges of vertical framing studs | 48 |
| returns of vertical framing studs | 50 |
| webs of upper and lower framing tracks | 52 |
| first legs of upper and lower framing tracks | 54 |
| second legs of upper and lower framing tracks | 56 |
| adhesive | 60 |
| fastening bolt | 62 |
| fastening nut | 64 |
| insulating sleeve | 66 |
| adhesive | 67 |
| disk | 68 |
| fastening screw | 70 |
| apertures | 71 |
| insulative anchoring nut | 72 |
| legs | 74 |
| base member | 76 |
| window | 78 |
| doorway | 80 |
| corner arrangement | 82 |
| shell member | 84 |
| insulative member | 86 |
| first leg | 88 |
| second leg | 90 |
| first threaded fastener | 92 |
| second threaded fastener | 94 |
| key | 96 |
| rectangular engaging member | 98 |
| slot | 100 |
| first engaging shoulder | 102 |
| second engaging shoulder | 104 |
| arched engaging member | 106 |
| locking notch | 108 |
| protuberance | 110 |
| flat edge | 112 |

DETAILED DESCRIPTION OF PREFERRED EMBODIMENTS

As is the case with many inventions, the present invention for a modular wall component with an insulative thermal break is subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

Figure 1:
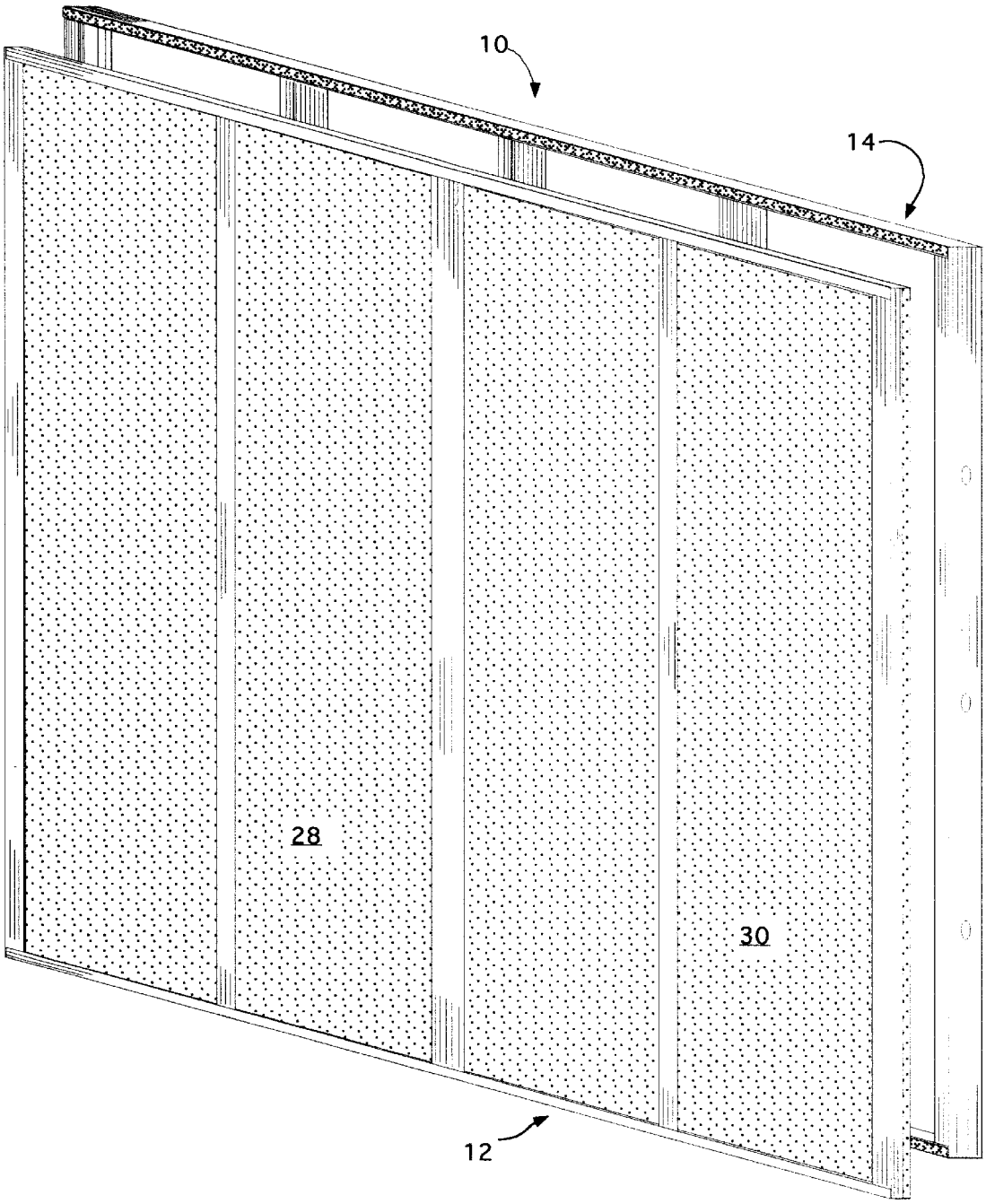
FIG. 1 is a perspective view of a partially disassembled embodiment of the present invention a modular wall component with an insulative thermal break.
Figure 2:
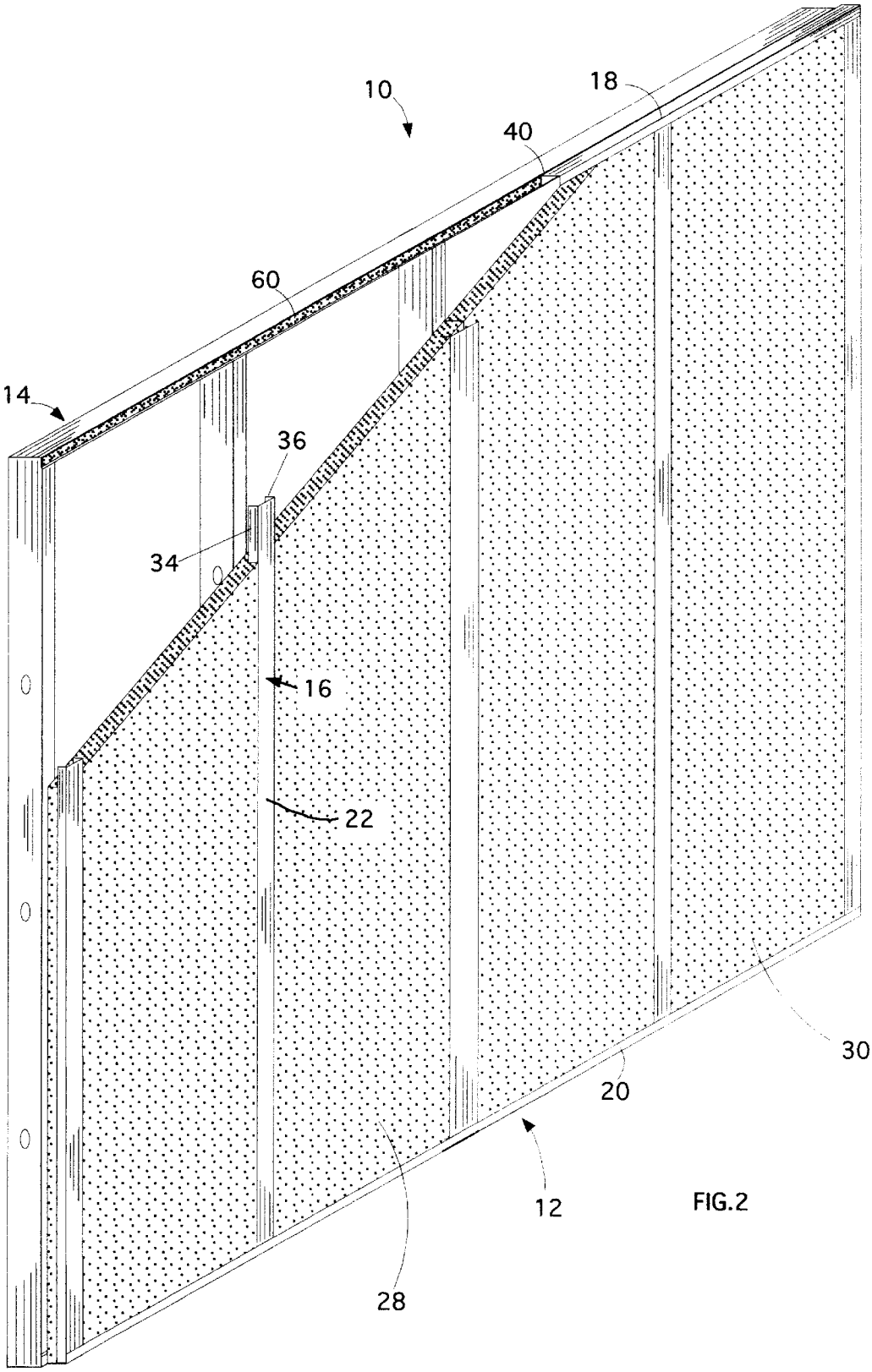
FIG. 2 is a perspective view of a partially sectioned, fully assembled embodiment of the present invention for a modular wall component with an insulative thermal break.

With this in mind and looking more particularly to the accompanying figures, a modular wall component with an insulative thermal break is indicated generally at 10 in FIG. 1 where the modular wall component 10 is shown partially disassembled for greatest clarity. As FIG. 1 shows, the modular wall component 10 is the product of coupling an outer, insulated frame structure 12 with an inner, open frame structure 14. As its name would suggest and as will be discussed more fully below, the insulated frame structure 12 retains first and second insulative sheets 28 and 30. In FIG. 2, the modular wall component 10 is shown with the insulated frame structure 12 coupled to the open frame structure 14 and with the insulated frame structure 12 partially sectioned away.

Figure 3:
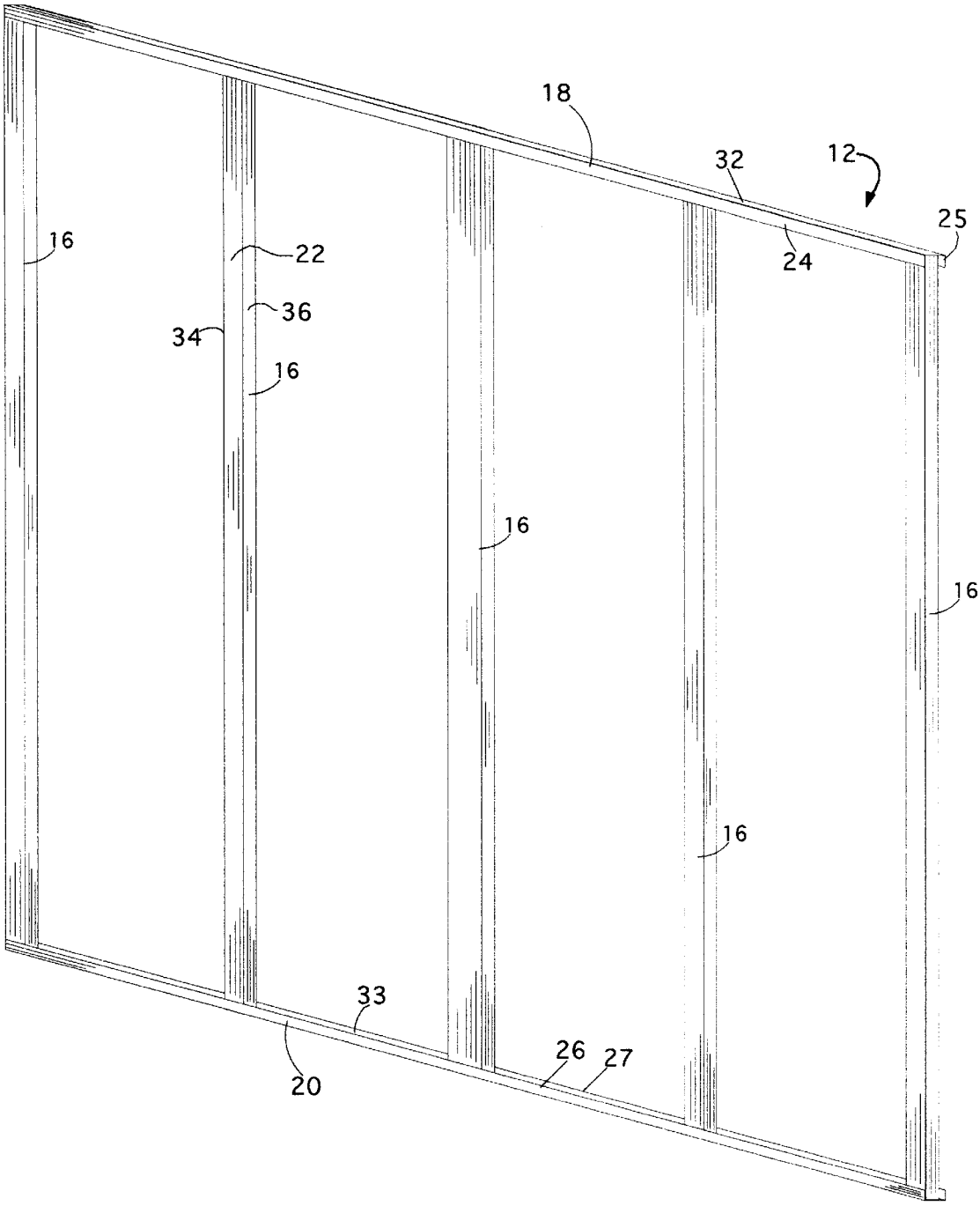
FIG. 3 is a perspective view of an outer, insulated frame structure devoid of its insulative layer.

By reference to FIGS. 1 and 2 in combination with FIG. 3 where the insulated frame structure 12 is shown devoid of the first and second insulative sheets 28 and 30, one can gain a fuller understanding of the construction of the insulated frame structure 12 of the present invention. From these figures, one will see that the insulated frame structure 12 is formed from an assembly of vertical track members 16 in combination with an upper track member 18 and a lower track member 20. In this most preferred embodiment, the vertical track members 16 are U-shaped metal members with each having a web 22 of approximately 2 inches in width and first and second legs 34 and 36 of approximately 1 inch in height. However, one will note that the vertical track member 16 that bridges the gap between may preferably be wider than the other vertical track members 16 since it bridges the juncture between the first and second insulative sheets. For example, although the majority of the vertical track members 16 have 2-inch webs, the bridging vertical track member 16 could have a web of, for example, 3 to 4 inches.

The upper and lower track members 18 and 20 also are U-shaped metal members. They are substantially equal in length whereby the insulated frame structure 12 is generally rectangular. The upper track member 18 has a web 32 and first and second legs 24 and 25, and the lower track member 20 has a web 33 and first and second legs 26 and 27. The upper and lower track members 18 and 20 are similarly dimensioned with each having webs 32 and 33 of approximately 2 inches in width and legs 24, 25, 26, and 27 of approximately 1.5 inches in height. The vertical track members 16 are oriented in a generally parallel configuration with each vertical track member 16 having an upper end and a lower end. The upper track member 18 traverses the upper ends of the vertical track members 16 with the webs 22 of the vertical track members 16 affixed to the first leg 24 of the upper track member 18. The lower track member 20 traverses the lower ends of the vertical track members 16 with the webs 22 of the vertical track members 16 affixed to the first leg 26 of the lower track member 20.

As FIGS. 1 and 2 show, in practice the first and second legs 34 and 36 of the vertical track members 16 of the insulated frame structure 12 are embedded in the first and second insulative sheets 28 and 30. This can be accomplished in a number of ways that will be known to one skilled in the art upon reading this disclosure. For example, slots corresponding to the legs 34 and 36 of the vertical track members 16 can be "hot wired" into the first and second insulative sheets 28 and 30 for receiving the legs 34 and 36 of the vertical track members 16 in a mating relationship. Alternatively, one could form the slots by cutting with any appropriate means, such as a router bit, a rotary saw, or the like. Most advantageously, however, the present inventor has devised of pressing the framing members 16 into uncut insulative sheets, such as the first and second insulative sheets 28 and 30, thereby to create and install the frame members 16 in a single step. In preferred embodiments, the first and second insulative sheets 28 and 30 are approximately as thick as the webs 32 and 33 of the upper and lower track members 18 and 20 are wide, but the first and second insulative sheets 28 and 30 are preferably thicker than the legs 34 and 36 of the vertical track members 16 are high. For example, in this exemplary embodiment the first and second insulative sheets 28 and 30 have a thickness of approximately 2 inches.

With this, the complete insulated frame structure 12 can be formed by inserting the legs 34 and 36 of the vertical track members 16 into the slots, however they are formed. As FIG. 2 shows most clearly, the center vertical track member 16 bridges the joint between the first and second insulative sheets 28 and 30 by having a first leg 34 embedded in the first insulative sheet 28, a second leg 36 embedded in the second insulative sheet 30, and the web 22 bridging the gap therebetween. Next, the upper and lower track members 18 and 20 can be applied to the upper and lower edges of the first and second insulative sheets 28 and 30. This is preferably done with the legs 24, 25, 26, and 27 of the upper and lower track members 18 and 20 straddling the upper and lower edges of the first and second insulative sheets 28 and 30 and the webs 32 and 33 of the upper and lower track members 18 and 20 respectively butting against the upper and lower edges of the first and second insulative sheets 28 and 30.

With the vertical track members 16 and the upper and lower track members 18 and 20 in place as described, the webs 22 of the vertical track members 16 are preferably fixed to the respective first legs 24 and 26 of the upper and lower track members 18 and 20 as is shown in FIG. 3. With this, the outer, insulated frame structure 12 will be rigidly formed, and the first and second insulative sheets 28 and 30 will be securely retained in place. The fixing of the vertical track members 16 to the upper and lower track members 18 and certainly could be accomplished in a number of ways that would occur to one skilled in the art. For example, the members 16, 18, and 20 could be joined by spot welding, by metal screws, by rivets, or even by adhesive.

Figure 4:
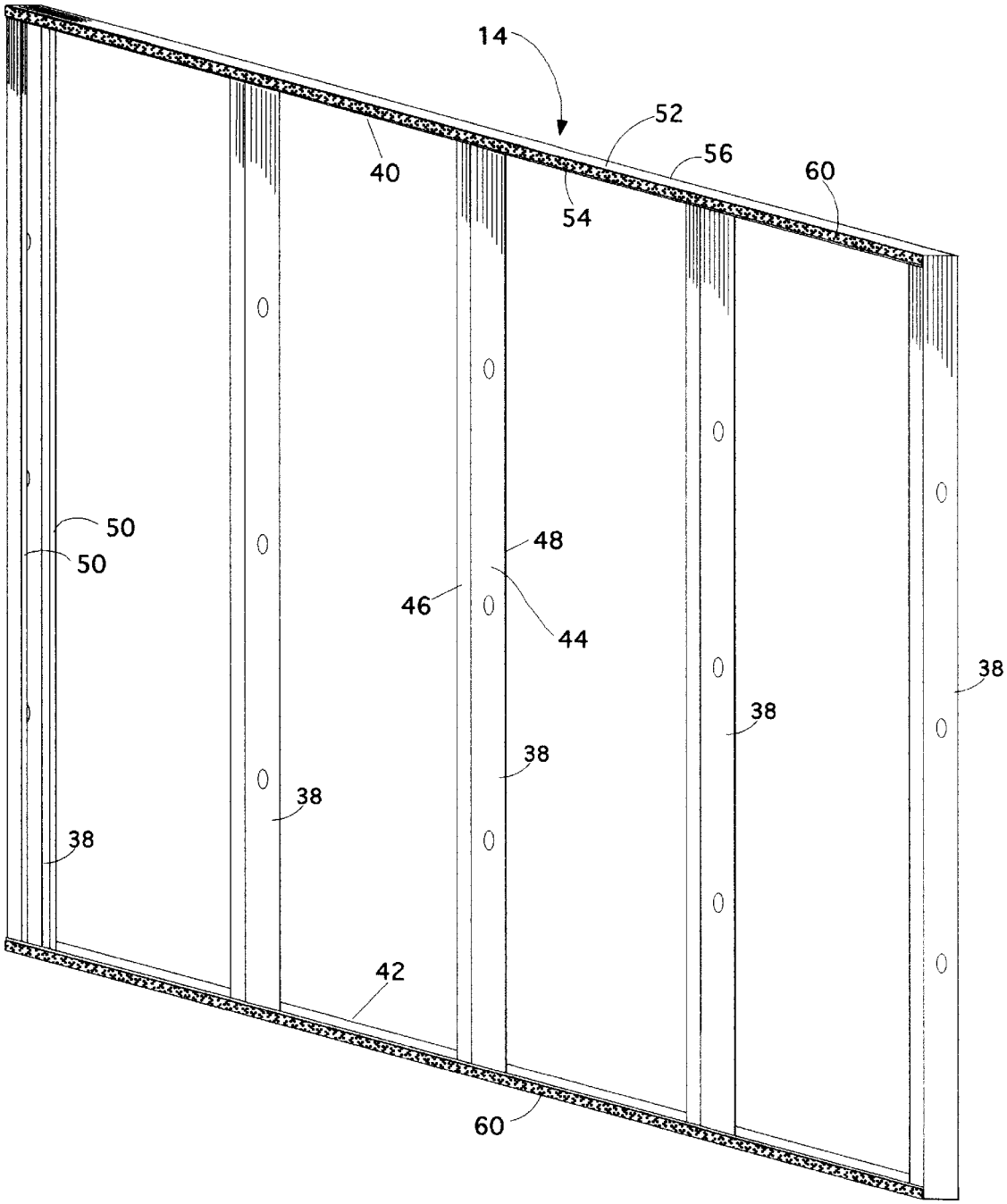
FIG. 4 is a perspective view of an inner, open frame structure.
Figure 5:
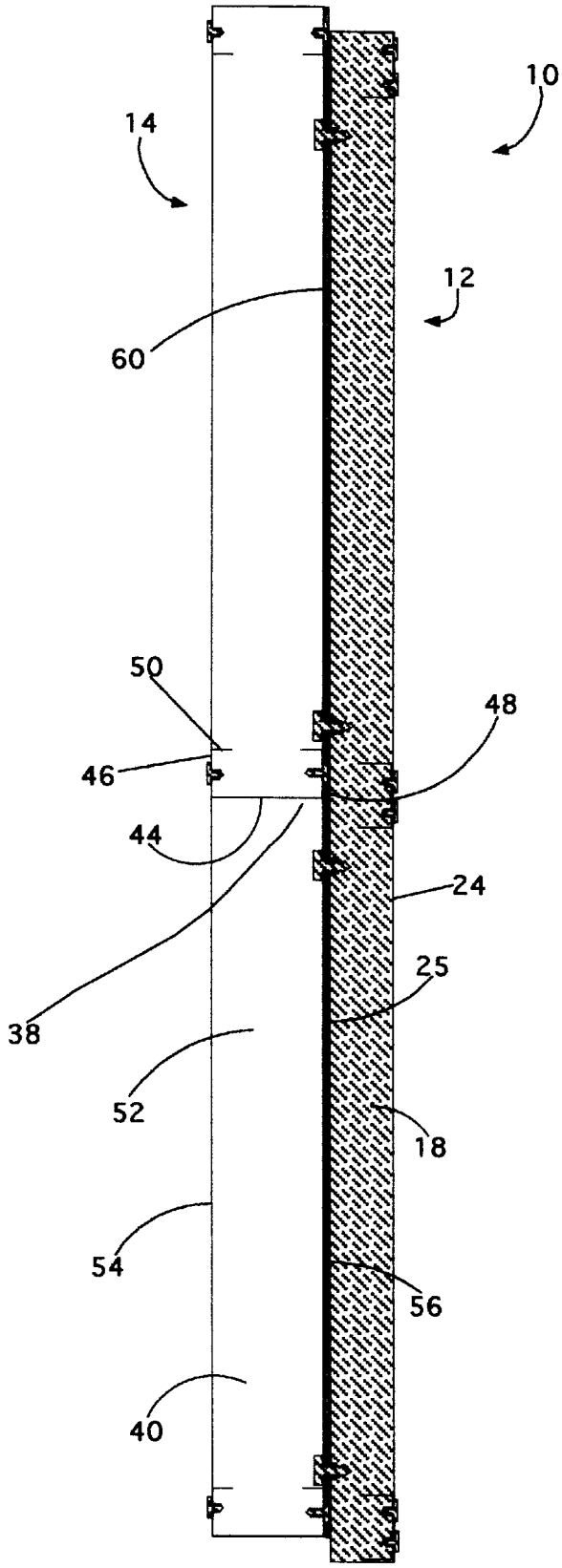
FIG. 5 is a top plan view of a fully assembled embodiment of the present invention for a modular wall component with an insulative thermal break.
Figure 6:
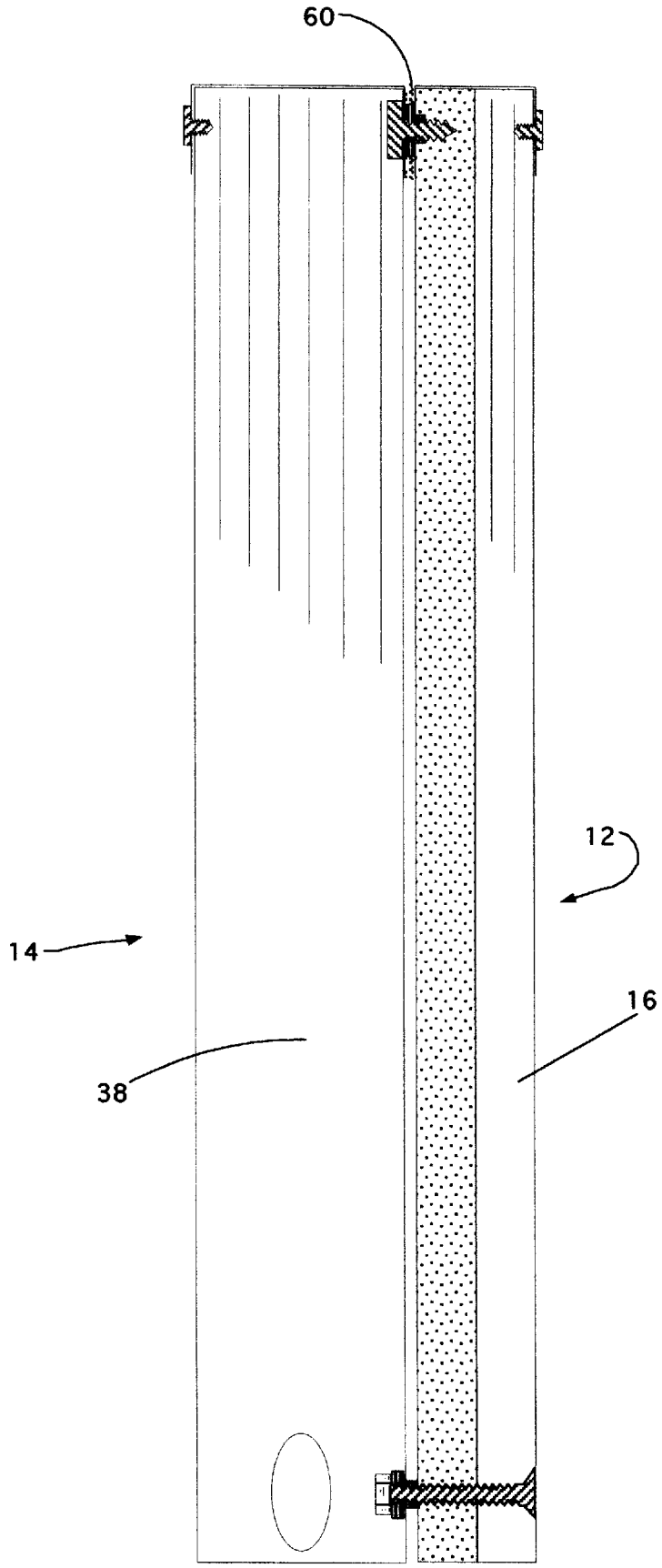
FIG. 6 is a view in side elevation of a fully assembled embodiment of the present it invention for a modular wall component with an insulative thermal break.

Looking next to FIGS. 4 and 5, one can gain a better understanding of the inner, open frame structure 14, which comprises the structural side of the modular wall component 10. The open frame structure 14 is formed from the assemblage of a plurality of vertical framing studs 38 with an upper framing track 40 and a lower framing track 42. The upper and lower framing tracks 40 and 42 are generally equal in length whereby the open frame structure 14 is generally rectangular. In this preferred embodiment, the vertical framing studs 38 are formed with a C-shaped cross section thereby improving the strength and rigidity of each of the vertical framing studs 38, the open frame structure 14, and the modular wall component 10 in general. Although the vertical framing studs 38 certainly could be vary in size widely, in this embodiment each of the vertical framing studs 38 has a web 44 that is 3.5 inches in width, first and second flanges 46 and 48 that are 1.5 inches in height, and returns 50 of ⅝ inches. The preferred upper and lower framing tracks 40 and 42 have a U-shaped cross section with a web 52 of 3 and ⅝ inches in width and first and second legs 54 and 56 of 1.5 inches in height.

The open frame structure 14 is assembled with the upper and lower ends of the vertical frame studs 38 respectively matingly received between the first and second legs 54 and 56 of the upper and lower framing tracks 40 and 42. In doing so, as FIG. 4 shows most clearly, the webs 44 of the vertical framing studs 38 adjacent to the ends of the open frame structure 14 face outwardly toward the ends of the open frame structure 14. The middle vertical framing studs 38 are shown in FIG. 4 with similar orientations to one another, but this need not be the case.

With the vertical framing studs 38 and the upper and lower framing tracks 40 and 42 in place as described, the first and second flanges 46 and 48 of the vertical framing studs 38 are fixed to the respective first and second legs 54 and 56 of the upper and lower framing tracks 40 and 42. With this, the inner, open frame structure 14 will be rigidly formed. The fixing of the vertical framing studs 38 to the upper and lower framing tracks 40 and 42 certainly could be accomplished in a number of ways that would occur to one skilled in the art. For example, the framing studs 38 and the upper and lower framing tracks 40 and 42 could be joined by spot welding, by metal screws, by rivets, by clinching methods, or even by adhesive.

With the inner, open frame structure 14 and the outer, insulated frame structure 12 assembled as described, the open frame structure 14 and the insulated frame structure 12 can be joined together as is shown, for example, in FIGS. 2, 5, 6, and 7. As FIG. 5 shows most clearly, the upper track member 18 of the insulated frame structure 12 and the upper framing track 40 of the open frame structure 14 are substantially equal in length. However, one will appreciate that the open frame structure 14 and the insulated frame structure 12 are not aligned with one another. Instead, they are staggered by a given amount. For example, in one preferred embodiment where the upper and lower track members 18 and 20 and the upper and lower framing tracks 40 and 42 are 4 feet in length, the insulated frame structure 12 and the open frame structure 14 are staggered by approximately ½ inch to ¾ inch.

With this, when modular wall components 10 according to the present invention are disposed in an edge-to edge relationship, the modular wall component 10 will interengage with an overhanging end of an insulated frame structure 12 of one modular wall component 10 overlapping with an overhanging end of an open frame structure 14 of an adjacent modular wall component 10. Advantageously, this overlapping of adjacent components 10 tends to fix adjacent wall components 10 relative to one another and thereby contributes to the structural rigidity, strength, and durability of a wall that is formed from a plurality of modular wall components 10.

However, one knowledgeable in the art will be aware that merely interengaging adjacent modular wall components 10 as described above would likely be insufficient to fix the modular wall components 10 together as securely as proper building construction standards would require. Accordingly, a further means for interconnecting adjacent modular wall components 10 is needed. This could be accomplished in a number of ways that might occur to one skilled in the art. For example, adjacent wall components 10 could be coupled by welding, by metal screws or bolts, or by adhesive. In one preferred method, adjacent wall components 10 are coupled by mechanical fasteners, such as sheet metal screws or bolts, that pass through the web 44 of one vertical framing stud 38 of a first wall component 10 and through the web 44 of one vertical framing stud 38 of a second wall component 10 whereby the first and second wall components 10 will be fixed with their end vertical framing studs 38 in a back-to-back relationship.

Figure 14:
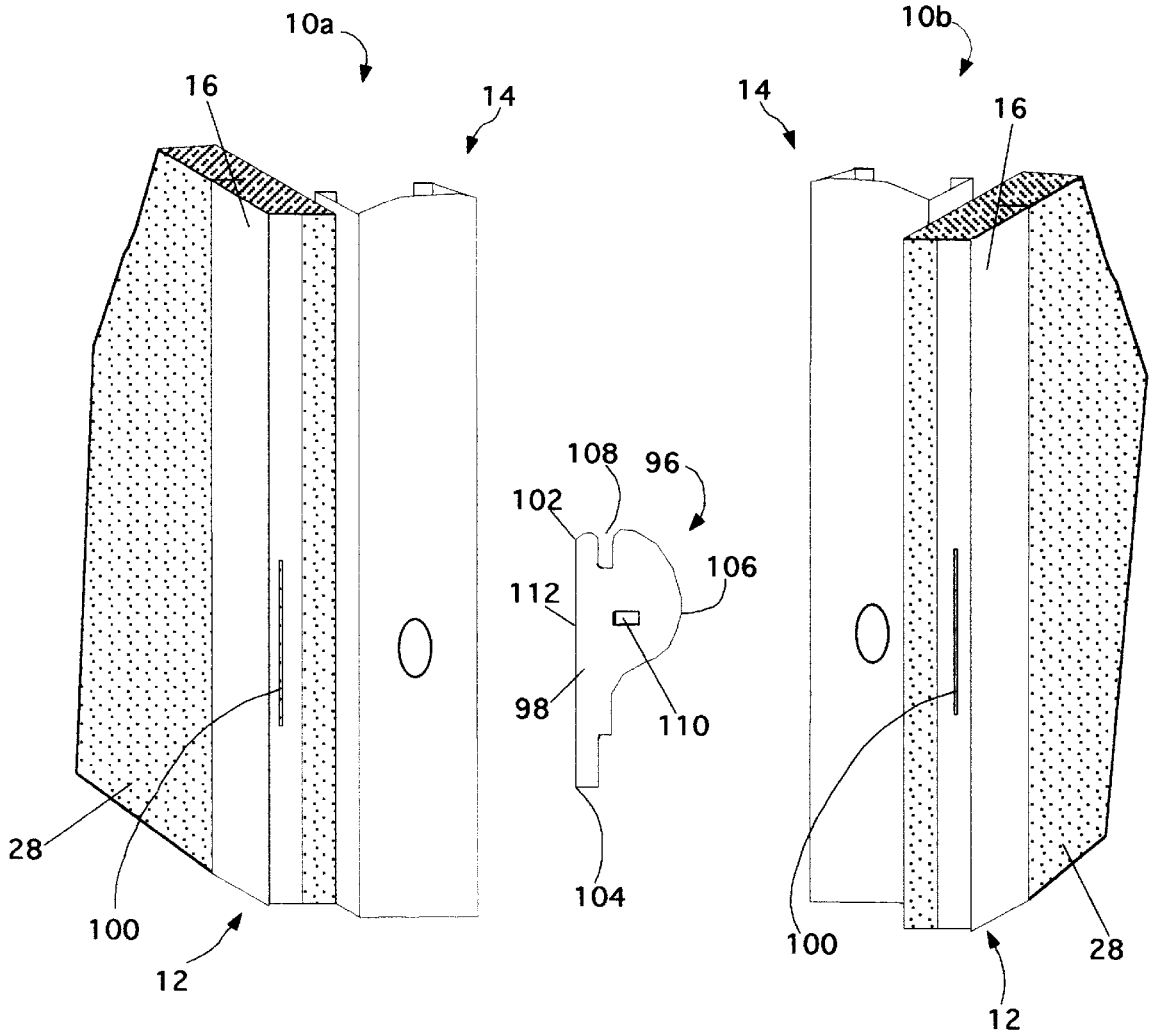
FIG. 14 is a perspective view of portions of first and second adjacent modular wall components and a means for coupling the first and second adjacent modular wall components.

An alternative and presently preferred method for securing adjacent wall components 10 together is illustrated in FIG. 14. There, first and second adjacent wall components 10*a* and 10*b* are depicted along with a key 96 that cooperates with slots 100 in the first and second adjacent wall components 10*a* and 10*b* to act as a means for coupling the first and second adjacent wall components 10*a* and 10*b*. The slots 100 are disposed in the vertical track members 16 and the insulated sheets 28 of the insulated frame structures 12. Advantageously, the slots 100 are disposed at identical positions on each of the wall components 10*a* and 10*b* such that the slots 100 will align automatically with one another without regard to the orientation of the wall components 10*a* and 10*b* (i.e., which end of the wall components 10*a* and 10*b* is up). To accomplish this, the slots 100 could be disposed precisely at a mid-point of each of the wall components 10*a* and 10*b*. Alternatively or additionally, pairs of slots 100 could be disposed equidistant from the mid-point of the wall components 10*a* and 10*b* so that the slots 100 will align automatically.

In any event, a particularly preferred key 96 is shown in FIG. 14. The key 96 has a generally rectangular engaging member 98 formed integrally with an arched engaging member 106. The rectangular engaging member 98 has a flat edge 112 and terminates at a first end in a first engaging shoulder 102 and at a second end in a second engaging shoulder 104. The arched engaging member 106 has the shape of one-half of a stereotypical heart shape with a bulbous portion adjacent to the first engaging shoulder 102 and a narrowing portion disposed adjacent to the second engaging shoulder 104. With this, a locking notch 108 is formed between the first engaging shoulder 102 and the bulbous portion of the arched engaging member 106. A protuberance 110 is formed on the key 96 in the arched engaging member 106 immediately adjacent to the rectangular engaging member 98. The distance from the base of the locking notch 108 to the end of the narrowing portion of the arched engaging member 106 is equal to or slightly less than the length of the slots 100. With this, it will be clear that the distance between the ends of the first and second engaging shoulders 102 and 104 is greater than the length of the slots 100.

To employ the key 96 and slot 100 arrangement to secure adjacent wall components 10*a* and 10*b* together, a user would first insert the second engaging shoulder 104 into the lower portion of the slot 100 in the first wall component 10*a* while pressing the flat surface 112 of the rectangular engaging member 98 against the upper end of the slot 100 in the first wall component 10*a* until the first engaging shoulder 102 clears the upper end of the slot 100. With this, the first engaging shoulder 102 can be inserted into the slot 100 such that both the first and second engaging shoulders 102 and 104 are disposed in the slot 100. The key 96 can then be slid upwardly so that the upper end of the slot 100 in the vertical track member 16 is received in the locking notch 108. The key 96 can then be pulled outwardly such that the first and second engaging shoulders 102 and 104 are disposed in contact with the inner surface of the vertical track member 16 and the entire rectangular engaging member is disposed within the slot 100 in the first wall component 10*a* while the arched engaging member 106 extends completely outside of the slot 100 in the first wall component 10*a*.

With this, the arched engaging member 106 can be inserted into the slot 100 in the second wall component 10*b* with the slot 100 of the second wall component 10*b* slightly above the slot 100 of the first wall component 10*a*. Once the second wall component 10*b* is sufficiently close to the first wall component 10*a*, the second wall component 10*b* can be slid downwardly relative to the first wall component 10*a* such that the upper end of the slot 100 in the vertical track member 16 in the second wall component 10*b* will be received into the locking notch 108. With the key 96 so positioned in each of the slots 100, the first and second wall components 10*a* and 10*b* will be flexed in position relative to one another. Advantageously, the protuberance 110 will prevent the key 96 from slipping into either of the slots 100 such that the first and second wall components 10*a* and 10*b* will remain properly secured together. Of course, the key 96 and slots 100 should be supplemented by additional means for securing the wall components 10*a* and 10*b* together. For example, a user could additionally employ screws, adhesive, or another means.

One will recall that a major disadvantage of prior art metal-frame modular wall components and, indeed, metal frame structural articles in general is that the metal frames of such devices tend to create continuous paths that allow for the transfer of heat both into and out of buildings that employ them. One will further recall that eliminating such continuous metal paths is among the principal objects of the present invention. In accomplishing that object, the present invention employs a plurality of mechanisms that prevent the formation of a continuous metal path.

What may be considered the first such mechanism is the interposition of a layer of thermally insulative structural adhesive 60 between the inner, open frame structure 14 and the outer, insulated frame structure 12 to prevent a thermal path from being formed therebetween. As such, the thermally insulative structural adhesive 60 may be termed equally aptly a thermal break, which is therefore also indicated at 60. With combined reference to FIGS. 2, 5, and 6, the astute observer will realize that the thermally insulative structural adhesive 60 is not disposed over the entire adjacent surfaces of the open frame structure 14 and the insulated frame structure 12. Instead, the thermally insulative structural adhesive 60 is applied substantially only where there would otherwise be metal-to-metal contact between the structures 12 and 14. With this, the thermally insulative structural adhesive 60 is applied between the entire lengths of the second leg 25 of the upper track member 18 of the insulated frame structure 12 and the second leg 56 of the upper framing track 40 of the open frame structure 14. Adhesive 60 is also applied between the entire lengths of the second leg 27 of the lower track member 20 of the insulated frame structure 12 and the second leg 56 of the lower framing track 42. With the adhesive 60 so disposed, the invention advantageously avoids the creation of through-metal paths across the insulated frame structure 12 and the open frame structure 14. With this, the previously described advantages of metal framework structures, such as light weight, durability, and strength, are achieved without suffering from the disadvantages typically associated therewith, such as costly heat gains and losses due to continuous metal-to-metal paths.

The second means for preventing the formation of a continuous metal path is the very construction of the insulated frame structure 12. By embedding the vertical track members 18 in the first and second insulative sheets 28 and 30 and employing vertical track members 18 with first and second legs 24 and 25 that are less high than the first and second insulative sheets are thick, there is no possibility of direct metal-to-metal contact between the vertical track members 18 and any portion of the open frame structure 14.

Still further, the present invention avoids the formation of continuous metal paths, and thus continuous thermal paths, by the means that it employs for coupling the various structural members to one another and the means by which the insulated frame structure 12 and the open frame structure 14 are joined together. The present inventor has devised of these means upon realizing that each of the traditionally employed mechanisms for joining structural members together suffer from one or more disadvantages. For example, spot welding and metal screws, while typically secure and durable, contribute to the creation of continuous metal paths that allow for undesirable heat gains and losses as were discussed above. Adhesive bonding, while advantageous as typically minimizing heat transmission, taken alone may lack the strength and durability required for structural use.

Figure 9:
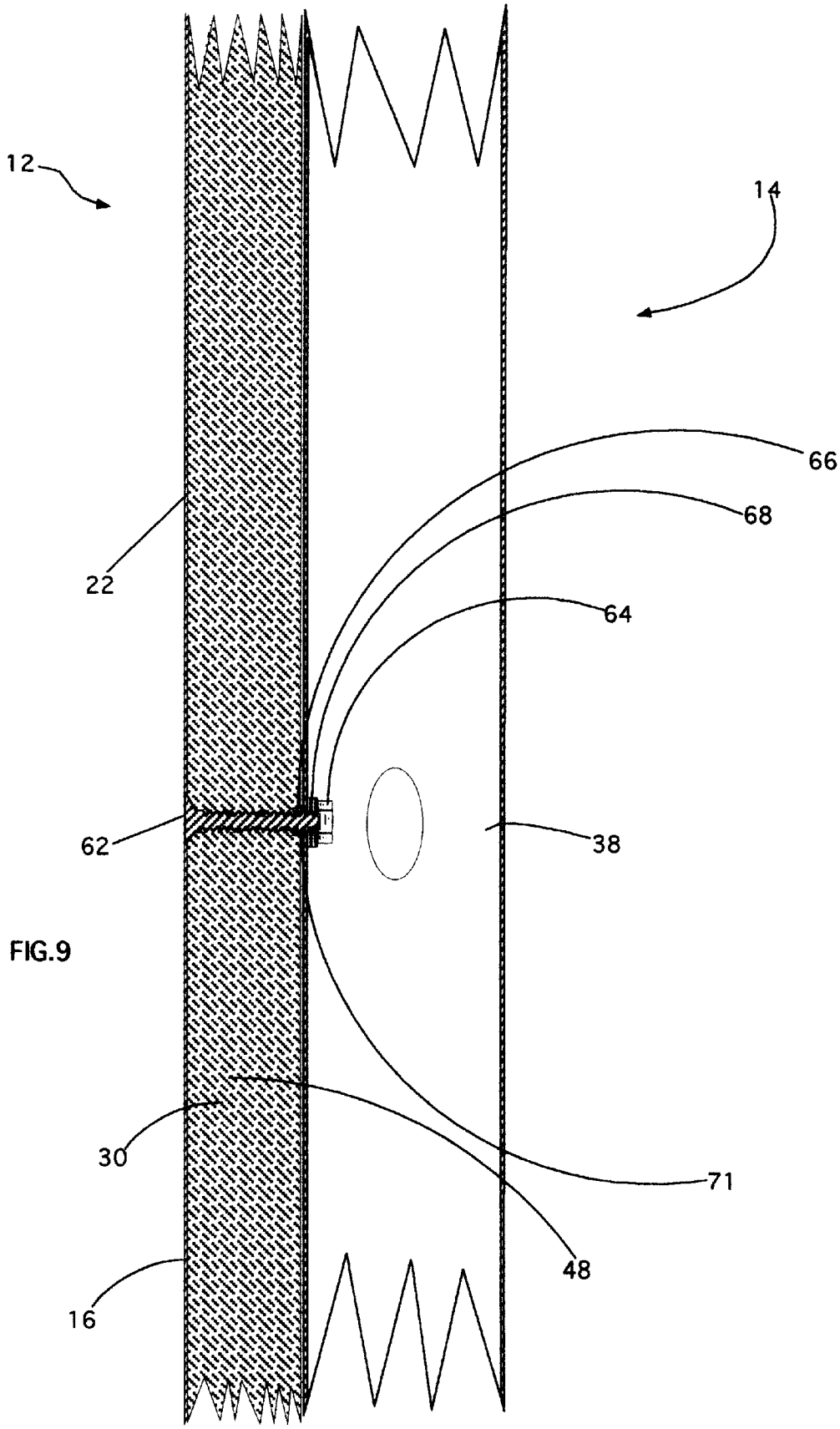
FIG. 9 is a sectional view depicting a preferred means for coupling the insulated frame structure to the open frame structure.

One means for mechanically securing the insulated frame structure 12 to the open frame structure 14 is depicted in FIG. 9. There, one sees that a fastening bolt 62 passes through the vertical track member 16, through the second insulative sheet 30, and through the second flange 48 of the vertical framing stud 38. A fastening nut 64 is threadedly engaged with the fastening bolt 62. Advantageously, however, a cylindrical insulating sleeve 66 with a torroidal insulating disk 68 surrounds the distal end of the fastening bolt 62. The insulating sleeve 66 and the insulating disk 68 certainly could be formed as a single piece. With this, direct contact between the fastening bolt 62 and the fastening nut 64 with the vertical framing stud 38 is eliminated. As a result, what would otherwise create a continuous metal path between the vertical track member 22 and the vertical framing stud 38 now creates an insulated mechanical connection. Together, a plurality of such fastening bolt 62, fastening nut 64, and insulating sleeve 66 arrangements securely fix the insulated frame structure 12 to the open frame structure 14.

One will appreciate that the insulative sleeve 66 could be formed from a variety of materials, so long as the resulting insulating sleeve 66 demonstrates a relatively low coefficient of heat transfer. For example, the insulating sleeve 66 could be formed from an appropriately chosen rubber or plastic. Under this arrangement, the structures 12 and 14 can enjoy the benefits of a mechanical connection incorporating, for example, steel fastening bolts 62 without the disadvantageous thermal properties commonly associated therewith. To ensure greatest accuracy during assembly of the wall panel 10, the vertical track members 22 and the vertical framing studs 38 could have apertures 71 pre-drilled therein whereby the possibility for misalignment of the insulated frame structure 12 relative to the open frame structure 14 would be substantially eliminated.

Figure 7:
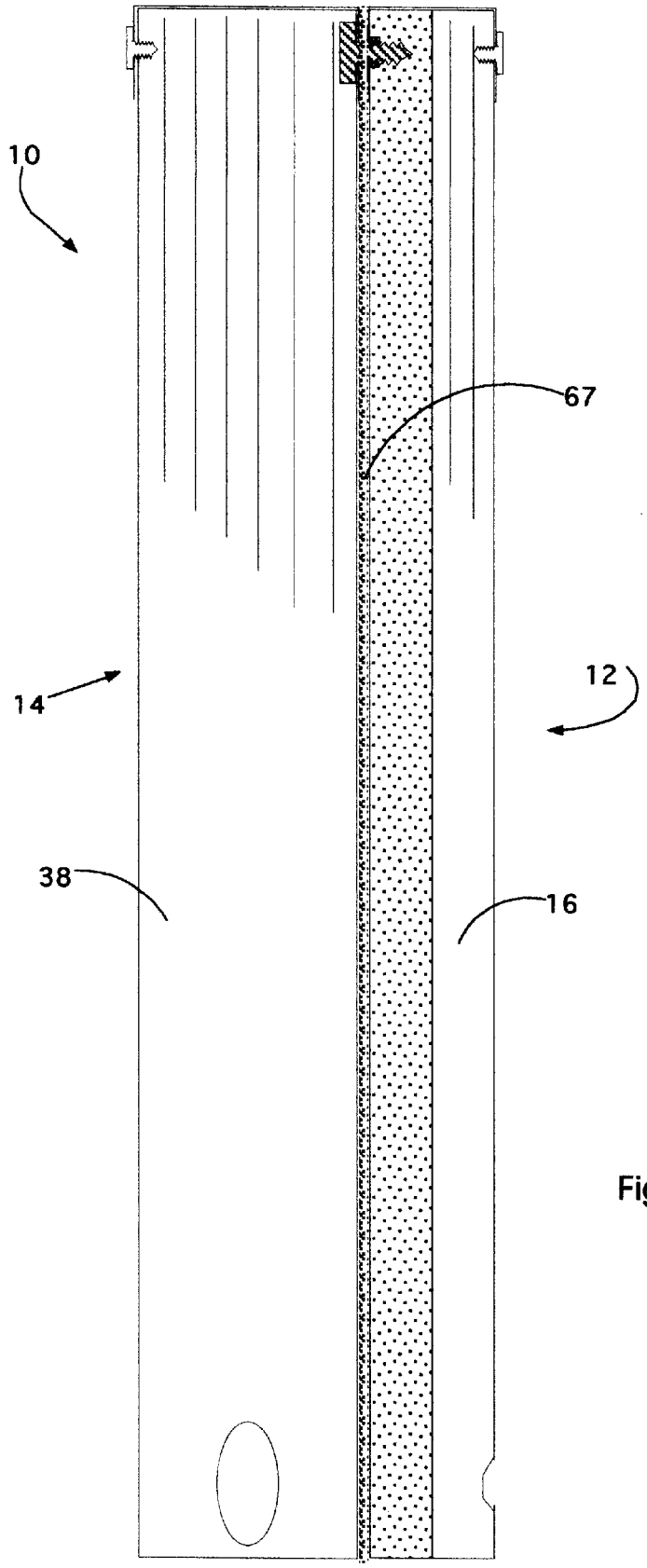
FIG. 7 is a view in side elevation of a fully assembled alternative embodiment of the invention.
Figure 9A:
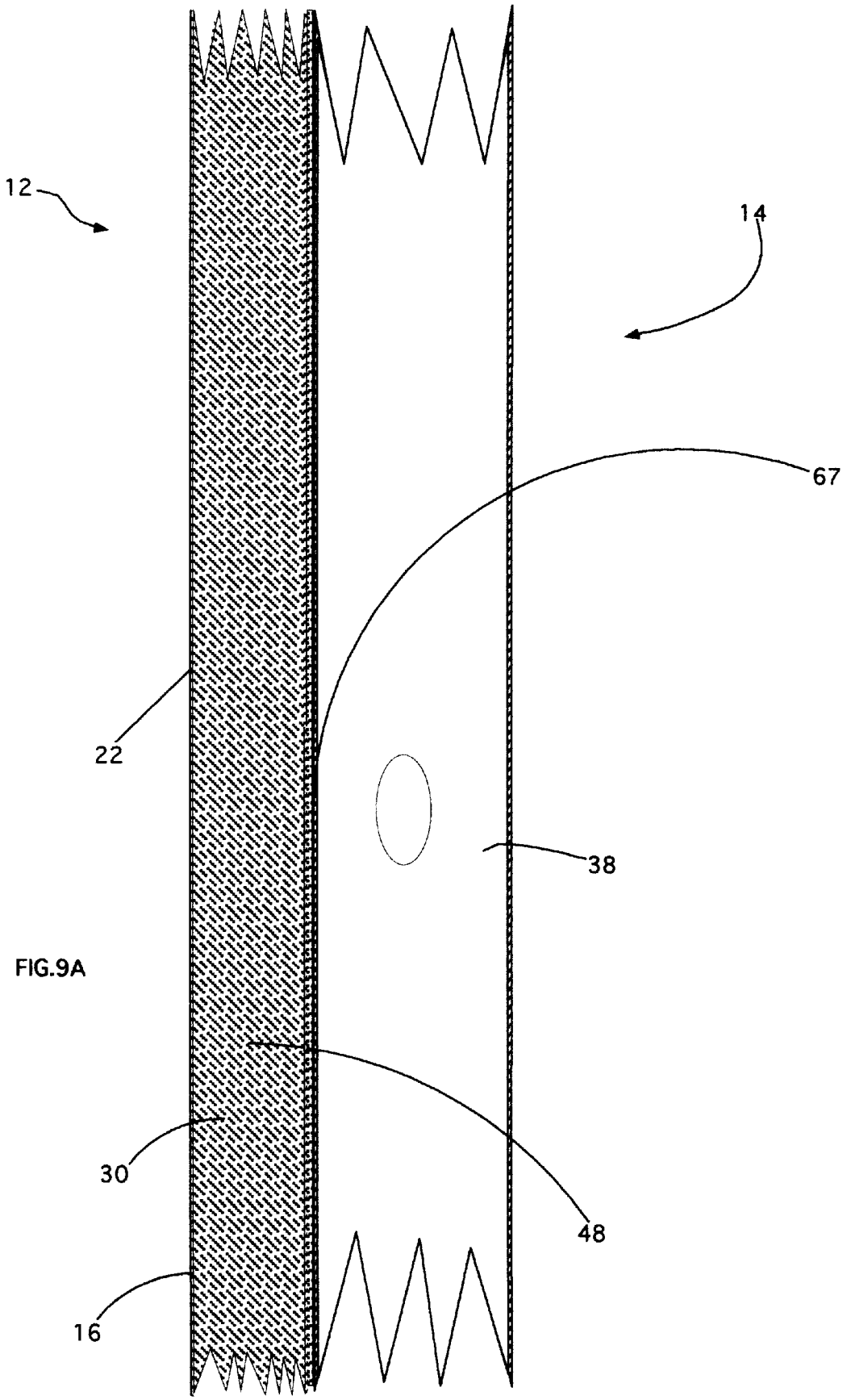
FIG. 9A is a sectional view depicting an alternatively preferred means for coupling the insulated frame structure to the open frame structure.

FIGS. 7 and 9A depict an alternative means for mechanically securing the insulated frame structure 12 to the open frame structure 14. In this embodiment, the fastening bolt 62, the fastening nut 64, and the cylindrical insulating sleeve 66 with its torroidal insulating disk 68 are eliminated. Instead, the insulated frame structure 12 and the open frame structure 14 are secured together by a layer of adhesive 67 that is disposed between the second insulative sheet 30 and the second flange 48 of the vertical framing stud 38. Under this embodiment, continuous thermal paths are again prevented.

Figure 10:
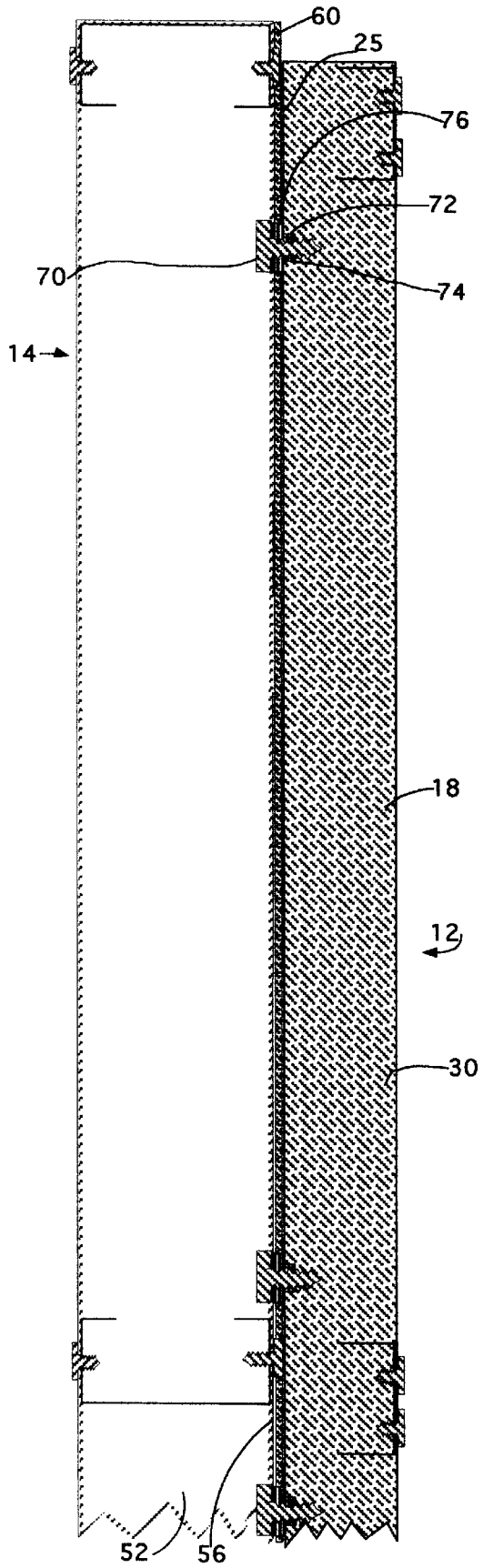
FIG. 10 is a sectional view of a preferred means for coupling the insulated frame structure to the open frame structure.

Similar advantage is gained by the invention's means for coupling other structural members to one another as is depicted, for example, in FIGS. 5 and 10. Looking for greatest clarity to FIG. 10, one sees that the second leg 56 of the upper framing track 52 is mechanically coupled to the second leg 25 of the upper track member 18 by a fastening screw 70 in combination with an insulative anchoring nut 72. The fastening screw 70 could be of a variety of types including screws formed of plastic or metal. The insulative anchoring nut 72 typically is formed from a generally rigid plastic and comprises a generally flat base member 76 that retains a plurality of resiliently biased legs 74.

In practice, a user will drill an appropriately sized bore hole into, in this example, the second leg 56 of the upper framing track, the adhesive 60, the second leg 25 of the upper track member 18, and partially into the insulative sheet 30. The anchoring nut 72 would then be popped into the bore hole in the upper track member 18 and partially into the insulative sheet 30, and then the fastening screw 70 would be passed through the second leg 56 of the upper framing track 52 and threaded into the anchoring nut 72. With this, the resiliently biased legs 74 will spread apart to lock the anchoring nut 72 and the fastening screw 70 in position. As a result, the upper framing track 52 and the upper track member 18 will be further fastened together. A plurality of such fastening screws 70 and anchoring nuts 72 can be employed to ensure a secure coupling between the joined members.

Advantageously, the insulative anchoring nut 72 functions not only as an anchoring nut for the fastening screw 70, but it also acts to insulate the fastening screw 70 relative to the second leg 25 of the upper track member 18. With this, the insulative anchoring nut 72 avoids the creation of a thermally conductive path between those members. Alternatively or additionally, the members could be fastened by insulates rivets (not shown), which also would prevent the creation of a continuous thermal path. Of course, the members could be fastened by other traditional means, such as simple nut and bolt arrangements, metal screws, or clinching methods. However, these would disadvantageously tend to create continuous thermal paths.

One further advantage of the present invention derives from employing anchoring nuts 72 that have base members 76 of a consistent thickness. With this, the distance between the insulated frame structure 12 to the open frame structure 14 is kept substantially constant. It is thereby ensured that the adhesive 60 is disposed between the insulated frame structure 12 to the open frame structure 14 in a consistent thickness.

FIG. 7 depicts an alternative embodiment of the invention that is substantially identical to the above-described embodiment of the wall component 10 except that the fastening screw 70 and the insulative anchoring nut 72 are eliminated. In their place is a layer of adhesive 67 that is disposed between the vertical framing stud 38 and the first and second insulative sheets 28 and 30. The layer of adhesive 67 supplements the layer of adhesive 60 in ensuring that the open frame structure 14 and the insulated frame structure 12 are securely joined without the creation of a through-metal path.

Figure 8:
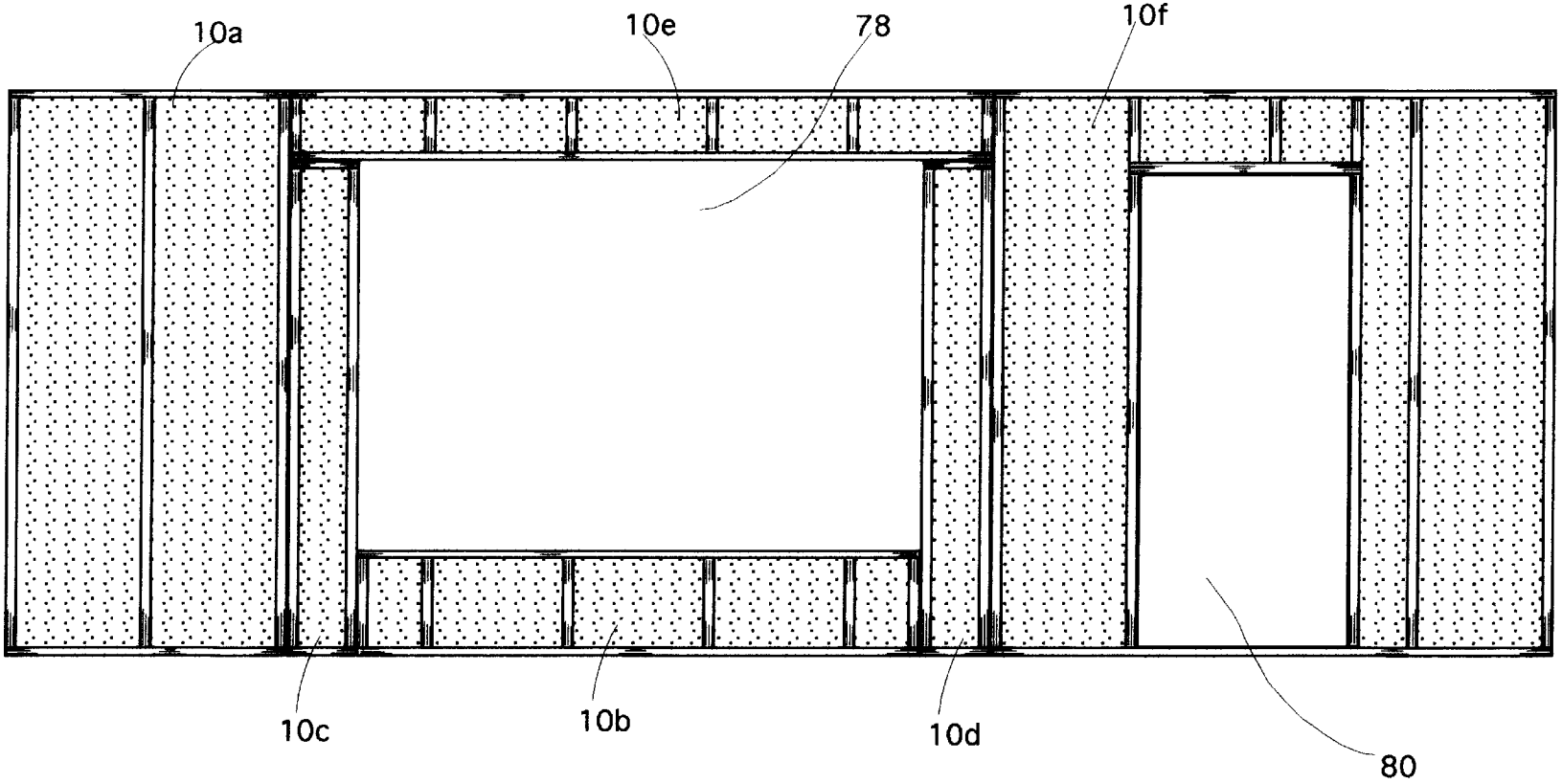
FIG. 8 is a view in front elevation of a wall structure formed from a plurality of varied embodiments of the present invention.

FIG. 8 merely exemplifies the versatility of the present invention where a plurality of differently constructed prefabricated wall components 10*a–f*. As one will see, wall component 10*a* is formed as a simple rectangle of a given width and a full wall height. Wall component 10*b–e* on the other hand are uniquely configured as shown to allow the creation of a window 78. Still further, wall component 10*f* is constructed with a doorway 80 formed integrally therein. Of course, these illustrated constructions are merely indicative of the wide variety of configurations that are within the scope of the present invention.

Figure 11:
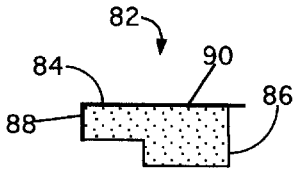
FIG. 11 is a cross-sectional plan view of a corner arrangement according to the present invention.

One will appreciate that adjacent modular wall components 10 necessarily must meet at generally right angles in certain locations, such as at a corner of a building structure. Advantageously, the present inventor has devices of a means for forming an efficient and secure corner arrangement between angularly related modular wall components 10 while nonetheless continuing to ensure that a continuous thermal path is not formed. A plan view of one such comer arrangement 82 is shown in FIG. 11. In this embodiment, the comer arrangement 82 is formed by the joining of a shell member 84 that has an L-shaped cross-section with an insulative member 86. Of course, the insulative member 86 and the shell member 84 could be coupled in a number of ways. However, it presently seems most preferable to do so with an adhesive or the like.

As FIG. 11 shows, the shell member 84 has a first leg 88 and a second leg 90. A distal end of the second leg 90 of the shell member 84 overhangs the insulative member 86 for reasons that will be described more fully below. The insulative member 86 is sized and shaped to complement adjacent wall components 10 as they meet at a right angle. With this, the corner arrangement 82 cooperates with adjacent wall components 10 to form a smooth, complete corner.

Figure 12:
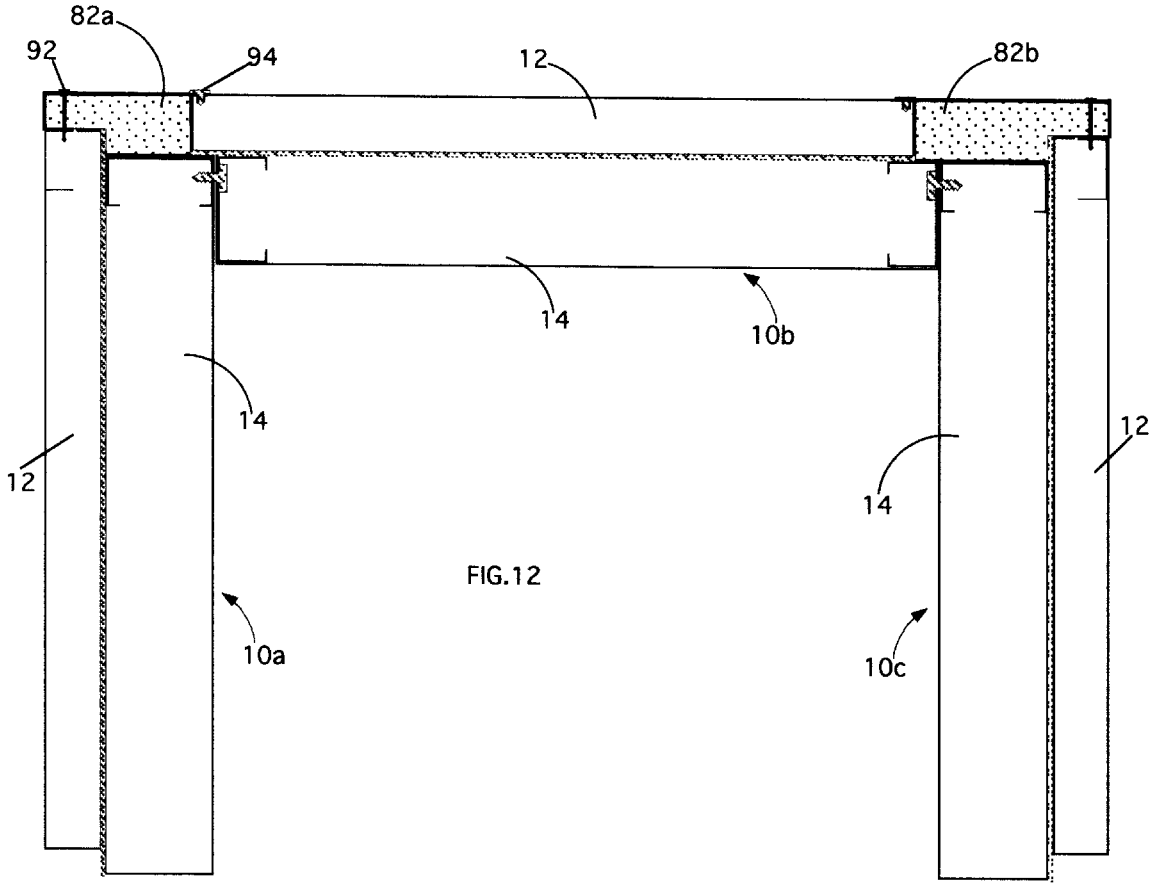
FIG. 12 is a top plan view of a cornered wall structure incorporating a plurality of modular wall components and corner arrangements according to the present invention.

Since adjacent wall components 10 can be expected to meet in a number of ways thereby leaving a number of different types of volumes left to filled in, one will appreciate that corner arrangements 82 must be crafted in a number of different cross-sectional shapes. FIG. 12 illustrates two such embodiments that accommodate two potential manners in which adjacent wall components 10 could meet. Stated more particularly, wall component 10*a* meets wall component 10*b* with the end of the insulated frame structure 12 of wall component 10*a* extending beyond the end of its open frame structure 14 and the open frame structure 14 of wall component 10*b* extending beyond the end of its insulated frame structure 12. With this, the corner arrangement 82*a* has an insulative member 86 with a cross-section that has an overall length equal to the thickness of the wall component 10*a* plus the amount that the insulated frame structure 12 of the wall component 10*b* is staggered relative to its open frame structure 14. The insulated member 86 has a thickness equal to the thickness of the insulated frame structure 12 of the wall component 10*b* except for an indentation equal in size and shape to the overhang of the insulated frame structure 12 of the wall component 10*a*.

The comer arrangement 82*a* can be installed as shown and then attached by a first threaded fastener 92 passing through the proximal end of the second leg 90 shell member 84, through the insulative member 86, and into the insulated frame structure 12 of the wall component 10*a*. A second threaded fastener 94 can pass through the overhanging distal end of the second leg 90 and into the insulated frame structure 12 of the wall component 10*b*. With this, the corner arrangement 82*a* will act to form a complete corner and to secure the wall components 10*a* and 10*b* together while continuing to prevent the creation of the continuous thermal path thereacross.

The comer arrangement 82*b* is adapted for forming a proper corner where the insulated frame structure 12 extends beyond the open frame structure 14 on both wall components 10*b* and 10*c*. With this, the comer arrangement 82*b* has an insulative member 86 with a cross-section that has an overall length equal to the thickness of the wall component 10*a* minus the amount that the insulated frame structure 12 of the wall component 10*b* is staggered relative to its open frame structure 14. The insulated member 86 has a thickness equal to the thickness of the insulated frame structure 12 of the wall component 10*b* except for an indentation equal in size and shape to the overhang of the insulated frame structure 12 of the wall component 10*c*.

Figure 13:
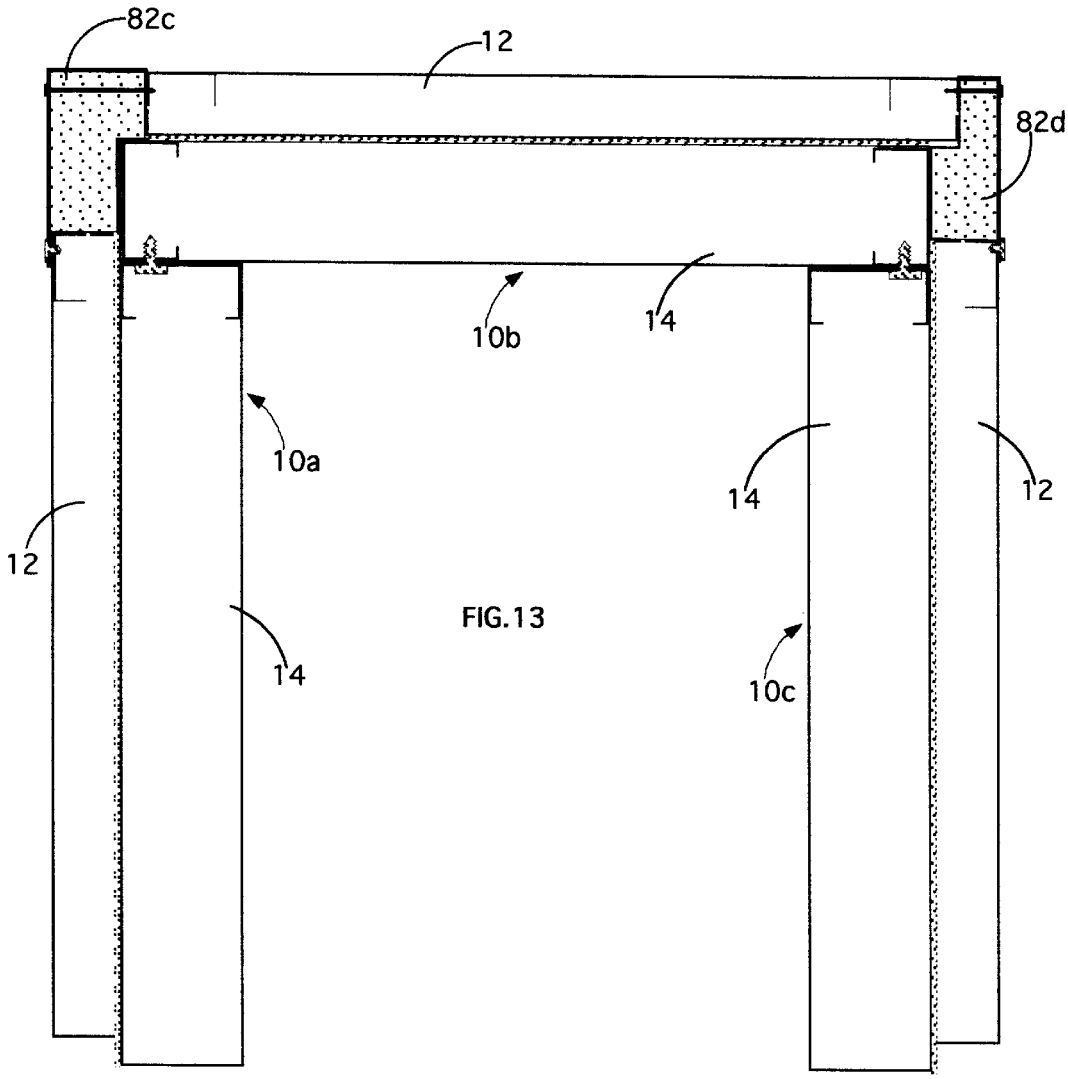
FIG. 13 is a top plan view of a cornered wall structure incorporating an additional plurality of modular wall components and corner arrangements.

Two still further comer arrangements 82*c* and 82*d* are shown in FIG. 13. There, the corner arrangement 82*c* has an insulative member 86 with a cross-section that has an overall length equal to the thickness of the wall component 10*b* minus the amount that the insulated frame structure 12 of the wall component 10*a* is staggered relative to its open frame structure 14. The insulated member 86 has a thickness equal to the thickness of the insulated frame structure 12 of the wall component 10*b* except for a thickened portion of a size equaling the thickness of the insulated frame structure 12 of the wall component 10*b* and the amount that that insulated frame structure 12 is staggered relative to the open frame structure 14 of the wall component 10*b*.

Finally, the corner arrangement 82*d* has an insulative member 86 with a cross-section that has an overall length equal to the thickness of the wall component 10*b* minus the amount that the insulated frame structure 12 of the wall component 10*c* is staggered relative to its open frame structure 14. The insulated member 86 has a thickness equal to the thickness of the insulated frame structure 12 of the wall component 10*c* except for an indentation equal in size and shape to the overhang of the insulated frame structure 12 of the wall component 10*b*.

Based on the foregoing, one will appreciate that the present invention for a modular wall component, such as that indicated at 10 in the accompanying drawings, achieves a plurality of advantages over the prior art. For example, the modular wall component 10 provides improved properties of thermal and acoustic insulation by eliminating continuous metal paths across the insulated frame structure 12 and the open frame structure 14 thereby preventing the creation of continuous thermal paths across the modular wall component 10. Most advantageous, the modular wall component 10 accomplishes the foregoing in a structure that is exceedingly simple and efficient in construction while demonstrating exemplary structural strength and rigidity. Furthermore, the modular wall component 10 enjoys the foregoing advantages while being light in weight to allow easy and safe lifting and moving. Further still, with the provision of metal surfaces on both sides of the modular wall component 10, it advantageously provides secure attachment surfaces on both sides thereof. Undoubtedly, these and still further advantages of the present invention will be readily obvious both to one who has reviewed the present disclosure and to one who has an opportunity to make use of an embodiment of the present invention for a modular wall component 10.

From the foregoing, it will be clear that the present invention has been shown and described with reference to certain preferred embodiments that merely exemplify the broader invention revealed herein. Certainly those skilled in the art can conceive of alternative embodiments. For instance, those with the major features of the invention in mind could craft embodiments that incorporate those major features while not incorporating all of the features included in the preferred embodiments.

With the foregoing in mind, the following claims are intended to define the scope of protection to be afforded the inventor, and the claims shall be deemed to include equivalent constructions insofar as they do not depart from the spirit and scope of the present invention. A plurality of the following claims express certain elements as a means for performing a specific function, at times without the recital of structure or material. As the law demands, these claims shall be construed to cover not only the corresponding structure and material expressly described in the specification but also equivalents thereof.

I claim as deserving the protection of United States Letters Patent:

1. A modular wall component with an insulative thermal break for preventing a creation of a continuous thermal path across the modular wall component, the modular wall component comprising:

an insulated frame structure comprising a plurality of interconnected structural frame members and a means for insulating the insulated frame structure;

an open frame structure comprising a plurality of interconnected structural frame members;

a means for fixing the insulated frame structure to the open frame structure; and an insulative thermal break interposed between the insulated frame structure and the open frame structure whereby a creation of a continuous thermal path across the modular wall component is prevented.

2. The modular wall component of claim 1 wherein the plurality of interconnected structural frame members of the insulated frame structure comprise a plurality of vertical track members coupled to upper and lower track members wherein each of the vertical track members and the upper and lower track members has a web portion and first and second legs.

3. The modular wall component of claim 2 wherein the plurality of vertical track members are coupled to the upper and lower track members with the web portion of each vertical track member fixed to the first legs of the upper and lower track members.

4. The modular wall component of claim 3 wherein the means for insulating the insulated frame structure comprises at least one sheet of insulative material.

5. The modular wall component of claim 4 wherein the at least one sheet of insulative material is interposed into the insulated frame structure with at least one of the first and second legs of each of the vertical track members embedded in the at least one sheet of insulative material.

6. The modular wall component of claim 5 wherein the plurality of interconnected structural frame members of the open frame structure comprises a plurality of vertical framing studs each with a web portion and first and second flanges coupled to an upper framing track and a lower framing track each with a web portion and first and second legs.

7. The modular wall component of claim 6 wherein the insulated frame structure and the open frame structure are coupled with the second leg of the upper track member of the insulated frame structure adjacent to the second leg of the upper framing track of the open frame structure and with the second leg of the lower track member of the insulated frame structure adjacent to the second leg of the lower framing track of the open frame structure whereby the webs of the vertical track members of the insulated frame structure are disposed outboard of the modular wall component.

8. The modular wall component of claim 7 wherein the first and second legs of each of the plurality of vertical track members have a given height that is less than a thickness of the at least one insulative sheet whereby the first and second legs of the vertical track member extend only partially through the at least one insulative sheet whereby contact between the vertical track members and the open frame structure is avoided thereby preventing a creation of a continuous thermal path between the insulated frame structure and the open frame structure.

9. The modular wall component of claim 7 wherein the insulative thermal break interposed between the insulated frame structure and the open frame structure comprises a layer of insulative adhesive material interposed between the second leg of the upper track member of the insulated frame structure and the second leg of the upper framing track of the open frame structure and a layer of insulative adhesive material interposed between the second leg of the lower track member of the insulated frame structure and the second leg of the lower framing track of the open frame structure thereby preventing the creation of a continuous thermal path between the insulated frame structure and the open frame structure.

10. The modular wall component of claim 9 wherein the means for fixing the insulated frame structure to the open frame structure comprises a plurality of threaded fasteners in combination with a plurality of threadedly engaged fastening nuts and further comprising an insulating sleeve of thermally insulative material surrounding at least a portion of each of the threaded fasteners thereby preventing a formation of a continuous thermal path between the insulated frame structure and the open frame structure along the plurality of threaded fasteners.

11. The modular wall component of claim 10 further comprising an insulating disk of thermally insulative material interposed proximal to each fastening nut thereby further preventing a formation of a continuous thermal path between the insulated frame structure and the open frame structure along the plurality of threaded fasteners.

12. The modular wall component of claim 10 wherein the open frame structure is assembled with the first and second flanges of the vertical framing studs coupled to the first and second legs of the upper and lower framing tracks and wherein the plurality of threaded fasteners pass through the webs of the vertical track members of the insulated frame structure, through the at least one insulative sheet, and through a flange of the vertical framing studs of the open frame structure.

13. The modular wall component of claim 10 wherein the upper and lower track members of the insulated frame structure are mechanically coupled to the upper and lower framing tracks of the open frame structure by a plurality of thermally insulative anchoring nuts in combination with a plurality of threaded fasteners.

14. The modular wall component of claim 13 wherein the insulative anchoring nut comprises a generally flat base member with a plurality of resiliently biased legs that project from the base member whereby the resiliently biased legs of the insulative anchoring nut can be inserted into a bore hole in the second leg of the upper framing track of the open frame structure and in the second leg of the upper track member of the insulated frame structure and the threaded fastener can be threaded into the insulative anchoring nut to cause the resiliently biased legs to spread apart thereby locking the threaded fastener and the insulative anchoring nut in place thereby fixing the upper framing track of the open frame structure and the upper track member of the insulated frame structure in place relative to one another.

15. The modular wall component of claim 1 wherein the means for fixing the insulated frame structure to the open frame structure comprises a plurality of threaded fasteners in combination with a plurality of threadedly engaged fastening nuts and further comprising an insulating sleeve of thermally insulative material surrounding at least a portion of each of the threaded fasteners thereby preventing a formation of a continuous thermal path between the insulated frame structure and the open frame structure along the plurality of threaded fasteners.

16. The modular wall component of claim 15 further comprising an insulating disk of thermally insulative material interposed proximal to each fastening nut thereby further preventing a formation of a continuous thermal path between the insulated frame structure and the open frame structure along the plurality of threaded fasteners.

17. The modular wall component of claim 1 wherein the interconnected structural frame members of the insulated frame structure are coupled to the interconnected structural frame members of the open frame structure by a plurality of thermally insulative anchoring nuts in combination with a plurality of threaded fasteners.

18. The modular wall component of claim 17 wherein the insulative anchoring nut comprises a generally flat base member with a plurality of resiliently biased legs that project from the base member whereby the resiliently biased legs of the insulative anchoring nut can be inserted into a bore hole in a structural frame member of the open frame structure and in a structural frame member of the insulated frame structure and the threaded fastener can be threaded into the insulative anchoring nut to cause the resiliently biased legs to spread apart thereby locking the threaded fastener and the insulative anchoring nut in place thereby fixing the structural frame member of the open frame structure and the structural frame member of the insulated frame structure in place relative to one another.

19. The modular wall component of claim 1 further comprising a means for coupling adjacent modular wall components together wherein the means for coupling adjacent modular wall components together comprises at least one slot with a given length disposed in an endmost structural frame member of at least one of the insulated frame structure and the open frame structure in combination with a key for being simultaneously received partially in the at least one slot in the endmost structural frame member of a first modular wall component and received partially in the at least one slot in the endmost structural frame member of a second modular wall component.

20. The modular wall component of claim 19 wherein the key comprises a first engaging member for being disposed in the at least one slot in the endmost structural frame member of the first modular wall component and a second engaging member for being disposed in the at least one slot in the endmost structural frame member of the second modular wall component, wherein the first and second engaging members meet at a juncture that has a length not substantially greater than the length of the slot, and wherein the first engaging member has first and second engaging shoulders spaced farther apart than the length of the slot whereby the key can be fixed in place with the first engaging member retained in the endmost structural frame member of the first modular wall component and the second engaging member retained in the endmost structural frame member of the second modular wall component.

21. A modular wall component with a means for preventing a creation of a continuous thermal path across the modular wall component, the modular wall component comprising:

a first frame structure comprising a plurality of interconnected structural frame members;

a second frame structure comprising a plurality of interconnected structural frame members;

a means for fixing the first frame structure to the second frame structure; and a means for preventing a creation of a continuous thermal path across the modular wall component;

wherein the means for fixing the first frame structure to the second frame structure comprises a plurality of threaded fasteners in combination with a plurality of threadedly engaged fastening nuts and further comprising an insulating sleeve of thermally insulative material surrounding at least a portion of each of the threaded fasteners whereby the plurality of threaded fasteners, the plurality of threadedly engaged fastening nuts, and the insulating sleeves comprise the means for preventing a formation of a continuous thermal path between the first frame structure and the second frame structure.

22. The modular wall component of claim 21 wherein the means for preventing a creation of a continuous thermal path across the modular wall component comprises an insulative thermal break interposed between the first frame structure and the second frame structure wherein the insulative thermal break comprises a layer of insulative adhesive material interposed between adjacent structural frame members of the first frame structure and the second frame structure.

23. The modular wall component of claim 21 further comprising an insulating disk of thermally insulative material interposed proximal to each fastening nut thereby further preventing a formation of a continuous thermal path between the first frame structure and the second frame structure along the plurality of threaded fasteners.

24. A modular wall component with a means for preventing a creation of a continuous thermal path across the modular wall component, the modular wall component comprising:

a first frame structure comprising a plurality of interconnected structural frame members;

a second frame structure comprising a plurality of interconnected structural frame members;

a means for fixing the first frame structure to the second frame structure; and a means for preventing a creation of a continuous thermal path across the modular wall component;

wherein the structural frame members of the first frame structure are mechanically coupled to the structural frame members of the second frame structure by a plurality of thermally insulative anchoring nuts in combination with a plurality of threaded fasteners.

25. The modular wall component of claim 24 wherein the insulative anchoring nut comprises a generally flat base member with a plurality of resiliently biased legs that project from the base member whereby the resiliently biased legs of the insulative anchoring nut can be inserted into a bore hole in a structural frame member of the first frame structure and in a structural frame member of the second frame structure and the threaded fastener can be threaded into the insulative anchoring nut to cause the resiliently biased legs to spread apart thereby locking the threaded fastener and the insulative anchoring nut in place thereby fixing the structural frame members of the first and second frame structures in place relative to one another.

26. The modular wall component of claim 24 wherein the plurality of interconnected structural frame members of the first frame structure comprise a plurality of vertical track members coupled to an upper track member and a lower track member wherein each of the vertical track members and the upper and lower track members has a web portion and first and second legs and wherein the plurality of vertical track members are coupled to the upper and lower track members with the web portion of each vertical track member fixed to the first legs of the upper and lower track members.

27. The modular wall component of claim 26 wherein the first frame structure further comprises at least one sheet of insulative material interposed into the first frame structure with at least one of the first and second legs of each of the vertical track members embedded in the at least one sheet of insulative material and wherein the first and second legs of each of the plurality of vertical track members have a given height that is less than a thickness of the at least one insulative sheet whereby the first and second legs of the vertical track members extend only partially through the at least one insulative sheet.

28. The modular wall component of claim 27 wherein the first and second frame structures are coupled with the web portions of the vertical track members of the first frame structure disposed outboard of the first and second frame structures whereby contact between the vertical track members of the first frame structure with the second frame structure is avoided thereby preventing a creation of a continuous thermal path between the first frame structure and the second frame structure.

29. The modular wall component of claim 24 further comprising a means for coupling adjacent modular wall components together wherein the means for coupling adjacent modular wall components together comprises at least one slot with a given length disposed in an endmost structural frame member of at least one of the first frame structure and the second frame structure in combination with a key for being simultaneously received partially in the at least one slot in the endmost structural frame member of a first modular wall component and received partially in the at least one slot in the endmost structural frame member of a second modular wall component.

30. The modular wall component of claim 29 wherein the key comprises a first engaging member for being disposed in the at least one slot in the endmost structural frame member of the first modular wall component and a second engaging member for being disposed in the at least one slot in the endmost structural frame member of the second modular wall component, wherein the first and second engaging members meet at a juncture that has a length not substantially greater than the length of the slot, and wherein the first engaging member has first and second engaging shoulders spaced farther apart than the length of the slot whereby the key can be fixed in place with the first engaging member retained in the endmost structural frame member of the first modular wall component and the second engaging member retained in the endmost structural frame member of the second modular wall component.

31. A modular wall component with an insulative thermal break for preventing a creation of a continuous thermal path across the modular wall component, the modular wall component comprising:

an insulated frame structure comprising a plurality of vertical track members and upper and lower track members wherein each of the vertical track members and upper and lower track members has a web portion and first and second legs wherein the web portion of each vertical track member is fixed to the first legs of the upper and lower track members;

at least one sheet of insulative material interposed into the insulated frame structure wherein at least one of the first and second legs of each of the vertical track members is embedded in the at least one sheet of insulative material;

wherein the first and second legs of each of the plurality of vertical track members of the insulated frame structure have a given height that is less than a thickness of the at least one insulative sheet whereby the first and second legs of the vertical track member extend only partially through the at least one insulative sheet;

an open frame structure comprising a plurality of vertical framing studs each with a web portion and first and second flanges coupled to an upper framing track and a lower framing track each with a web portion and first and second legs;

a means for fixing the insulated frame structure to the open frame structure wherein the insulated frame structure and the open frame structure are coupled with the second leg of the upper track member of the insulated frame structure adjacent to the second leg of the upper framing track of the open frame structure and with the second leg of the lower track member of the insulated frame structure adjacent to the second leg of the lower framing track of the open frame structure whereby the webs of the vertical track members of the insulated frame structure are disposed outboard of the modular wall component; and an insulative thermal break interposed between the insulated frame structure and the open frame structure comprising a layer of insulative adhesive material interposed between the second leg of the upper track member of the insulated frame structure and the second leg of the upper framing track of the open frame structure and a layer of insulative adhesive material interposed between the second leg of the lower track member of the insulated frame structure and the second leg of the lower framing track of the open frame structure.

32. The modular wall component of claim 31 wherein the means for fixing the insulated frame structure to the open frame structure comprises a plurality of threaded fasteners in combination with a plurality of threadedly engaged fastening nuts and further comprising an insulating sleeve of thermally insulative material surrounding at least a portion of each of the threaded fasteners thereby preventing a formation of a continuous thermal path between the insulated frame structure and the open frame structure along the plurality of threaded fasteners.

33. The modular wall component of claim 32 further comprising an insulating disk of thermally insulative material interposed proximal to each fastening nut thereby further preventing a formation of a continuous thermal path between the insulated frame structure and the open frame structure along the plurality of threaded fasteners.

34. The modular wall component of claim 31 wherein the upper and lower track members of the insulated frame structure are mechanically coupled to the upper and lower frame tracks of the open frame structure by a plurality of thermally insulative anchoring nuts in combination with a plurality of threaded fasteners.

35. The modular wall component of claim 34 wherein the insulative anchoring nut comprises a generally flat base member with a plurality of resiliently biased legs that project from the base member whereby the resiliently biased legs of the insulative anchoring nut can be inserted into a bore hole in the second leg of the upper framing track of the open frame structure and in the second leg of the upper track member of the insulated frame structure and the threaded fastener can be threaded into the insulative anchoring nut to cause the resiliently biased legs to spread apart thereby locking the threaded fastener and the insulative anchoring nut in place thereby fixing the upper framing track of the open frame structure and the upper track member of the insulated frame structure in place relative to one another.

* * * * *